US009249609B2

(12) United States Patent
Takahashi et al.

(10) Patent No.: US 9,249,609 B2
(45) Date of Patent: Feb. 2, 2016

(54) DOOR SUSPENSION DEVICE FOR SUPPORTING DOOR AND DOOR APPARATUS COMPRISING THE SAME

(75) Inventors: Kazutama Takahashi, Hyogo (JP); Katsuji Kawasaki, Hyogo (JP)

(73) Assignee: Nabtesco Corporation, Tokyo (JP)

( * ) Notice: Subject to any disclaimer, the term of this patent is extended or adjusted under 35 U.S.C. 154(b) by 0 days.

(21) Appl. No.: 14/118,163

(22) PCT Filed: May 9, 2012

(86) PCT No.: PCT/JP2012/061886

§ 371 (c)(1), (2), (4) Date: Nov. 15, 2013

(87) PCT Pub. No.: WO2012/157492

PCT Pub. Date: Nov. 22, 2012

(65) Prior Publication Data

US 2014/0090301 A1 Apr. 3, 2014

(30) Foreign Application Priority Data

May 16, 2011 (JP) ..... 2011-109371

(51) Int. Cl.
*E05D 15/06* (2006.01)
*E05F 15/00* (2015.01)
(Continued)

(52) U.S. Cl.
CPC ..... *E05D 15/0626* (2013.01); *E05D 15/063* (2013.01); *E05F 15/00* (2013.01); *E05F 15/632* (2015.01); *E05F 15/643* (2015.01); *E05Y 2201/614* (2013.01); *E05Y 2900/51* (2013.01)

(58) Field of Classification Search
CPC . E05D 15/0626; E05D 15/643; E05D 15/632; E05D 15/063; E05D 15/00
USPC ..... 49/409, 410, 413, 414, 415, 417, 418, 49/425, 360; 16/97, 98, 99, 102, 103, 105, 16/106, 91
See application file for complete search history.

(56) References Cited

U.S. PATENT DOCUMENTS 1,681,545 A * 8/1928 Lang ..... 49/102
2,650,387 A * 9/1953 Foss ..... 16/91
(Continued)

FOREIGN PATENT DOCUMENTS

CN 101678839 A 3/2010
CN 102667042 A 9/2012
(Continued)

OTHER PUBLICATIONS

International Search Report; PCT/JP2012/061886; Jun. 5, 2012.
(Continued)

*Primary Examiner* — Katherine Mitchell
*Assistant Examiner* — Marcus Menezes
(74) *Attorney, Agent, or Firm* — Studebaker & Brackett PC

(57) ABSTRACT

A door suspension has a compact structure, in which first door rollers run in contact with a lower rail, and are rotatably supported to a first door roller supporting member that suspends a door; second door rollers are rotatably supported to swing members swingably connected to the first door roller supporting member, and are provided so as to be capable of coming into contact with an upper rail; a drive connection portion holds the door and connects the door to an open-close drive mechanism; and an elastic connection mechanism includes an elastic portion capable of changing the relative positions of the second door rollers and the drive connection portion, and connects the swing members to the drive connection portion. The second door rollers are installed between the first door rollers on the door leading end side and the door trailing end side.

9 Claims, 15 Drawing Sheets

(51) Int. Cl.
*E05F 15/632* (2015.01)
*E05F 15/643* (2015.01)

(56) References Cited

U.S. PATENT DOCUMENTS

| | | | | | |
|---|---|---|---|---|---|
| 2,659,939 | A * | 11/1953 | Greig | 49/425 |
| 2,940,112 | A * | 6/1960 | Riser | 16/105 |
| 3,798,839 | A * | 3/1974 | Kaufman | 49/127 |
| 4,149,615 | A * | 4/1979 | Kappenhagen | 187/324 |
| 4,452,014 | A * | 6/1984 | Markus | 49/360 |
| 4,876,765 | A * | 10/1989 | Karita | 16/102 |
| 7,703,242 | B2 * | 4/2010 | Goebel et al. | 49/425 |
| 8,418,406 | B2 * | 4/2013 | Zimmer et al. | 49/379 |
| 2004/0255517 | A1 * | 12/2004 | Inage | 49/409 |
| 2007/0033877 | A1 | 2/2007 | Goebel et al. | |
| 2007/0180774 | A1 * | 8/2007 | Romero et al. | 49/425 |

FOREIGN PATENT DOCUMENTS

| | | | |
|---|---|---|---|
| EP | 2165909 | A1 | 3/2010 |
| EP | 2476848 | A1 | 7/2012 |
| EP | 2503087 | A1 | 9/2012 |
| GB | 1084812 | A | 9/1967 |
| JP | 47-004623 | Y1 | 2/1972 |
| JP | 10-002330 | A | 1/1998 |
| TW | M316920 | U | 8/2007 |
| TW | 201115007 | A | 5/2011 |
| WO | 2008-149632 | A1 | 12/2008 |

OTHER PUBLICATIONS

The English translation of Written Opinion of the International Search Authority; PCT/JP2012/061886; Jun. 5, 2012.

An Office Action; "Notice of the Opinion on Examination," issued by the Taiwanese Patent Office on Jun. 17, 2014, which corresponds to Taiwanese Patent Application No. 101117041 and is related to U.S. Appl. No. 14/118,163; with English language partial translation.

The extended search report issued by the European Patent Office on Sep. 17, 2014, which corresponds to European Patent Application No. 127851202-1607 and is related to U.S. Appl. No. 14/118,163.

The second Office Action issued by the Chinese Patent Office on Aug. 12, 2015, which corresponds to Chinese Patent Application No. 201280023421.5 and is related to U.S. Appl. No. 14/118,163; with English language abstract.

* cited by examiner

DOOR SUSPENSION DEVICE FOR SUPPORTING DOOR AND DOOR APPARATUS COMPRISING THE SAME

TECHNICAL FIELD

The present invention relates to a door suspension device that supports a door provided in a structure and driven to be opened and closed by an open-close drive mechanism, in a state in which the door is suspended to the structure so as to be slidably moved, and that is connected to the open-close drive mechanism, and a door apparatus provided with the door suspension device.

BACKGROUND ART

Conventionally, door suspension devices that support a door provided in a structure and driven to be opened and closed by an open-close drive mechanism, in a state in which the door is suspended to the structure so as to be slidably moved, and that is connected to the open-close drive mechanism are known (for example, see Patent Document 1). As a door suspension device used in a railroad vehicle serving as a structure, Patent Document 1 discloses a door suspension device including a rail member including an upper rail and a lower rail, and a door roller device including door rollers that run on the rail member. Also, in Patent Document 1, a door suspended to the door suspension device is driven to be opened and closed by an open-close drive mechanism connected to the door suspension device, and the door is supported in a state of being suspended to the structure, which is a side wall of the railroad vehicle, so as to be slidably moved.

Further, the door roller device of the aforementioned door suspension device is provided with a supporting member disposed along the lengthwise direction of the rail member, and this supporting member is provided with a first door roller capable of running on the lower rail and a second door roller capable of running on the upper rail. The second door roller is provided at one end of the supporting member, and a suspender capable of suspending the door is provided on the other end of the supporting member. Accordingly, the self-weight of the door is exerted on the suspender, the second door roller comes into contact with the upper rail with the first door roller, which runs on the lower rail, serving as a fulcrum, and the door is thereby supported. Accordingly, it is possible to provide a door suspension device that can prevent the derailing of doors from a rail member, enable smooth and safe opening and closing of doors, and achieve a reduction in manufacturing and installation costs.

CITATION LIST

Patent Document

Patent Document 1: WO2008/149632

DISCLOSURE OF THE INVENTION

Problem to be Solved by the Invention

With the door suspension device disclosed in Patent Document 1, a mechanism is provided that prevents the derailing of the door rollers from the rail by causing the self-weight of the door to exert the load for pressing the second door roller against the upper rail with the first door roller running on the lower rail as a fulcrum, and therefore, it is also possible to prevent the tilting of the door. However, with the door suspension device of Patent Document 1, the second door roller runs on the upper rail while being constantly pressed against the upper rail at a contact pressure in proportion to the self-weight of the door due to the load acting with the first door roller as a fulcrum, exerted by the self-weight of the door. Accordingly, when the door rollers are running on the rail, running resistance in proportion to the self-weight of the door is generated in the derailing prevention mechanism, which results in a reduction in the driving efficiency of the open-close drive mechanism when driving the doors to be opened and closed. Further, the generation of running resistance in proportion to the self-weight of the door may promote wear of the door rollers.

In view of the above-described circumstances, it is an object of the present invention to provide a door suspension device capable of reliably preventing the derailing of door rollers and the tilting of a door when the door is opened and closed, while reducing running resistance caused by a derailing prevention mechanism, and also to provide a door apparatus provided with the door suspension device.

Means for Solving the Problem

A door suspension device according to the first aspect of the present invention for achieving the above-stated object is a door suspension device that supports a door provided in a structure and driven to be opened and closed by an open-close drive mechanism, in a state in which the door is suspended to the structure so as to be slidably moved, and that is connected to the open-close drive mechanism, the device comprising: a rail that is fixed to the structure and includes an upper rail and a lower rail that are provided with respective running surfaces opposing each other in the vertical direction; a first door roller that runs in contact with the running surface of the lower rail; a first door roller supporting member that suspends the door and rotatably supports the first door roller; a plurality of swing members that are swingably connected to the first door roller supporting member; a second door roller that is rotatably supported to at least one of the swing members and is provided so as to be capable of coming into contact with the running surface of the upper rail; a drive connection portion for holding the door and connecting the door to the open-close drive mechanism; and an elastic connection mechanism that includes an elastic portion capable of changing relative positions of the second door roller and the drive connection portion by elastic deformation and connects the swing members to the drive connection portion, wherein the first door roller is provided on both a door leading end side, which is a side on which an end of the door in a closing direction is located, and a door trailing end side, which is a side on which an end of the door in an opening direction is located, with respect to the first door roller supporting member, and the second door roller is installed between the first door roller on the door leading end side and the first door roller on the door trailing end side in an opening and closing direction of the door.

According to this aspect of the invention, the first door roller supported to the first door roller supporting member that suspends the door runs on the lower rail, and the second door roller supported to the swing members that are swingably connected to the first door roller supporting member are installed so as to be capable of coming into contact with the upper rail. Accordingly, the first door roller and the second door roller that are installed between the upper and lower rails and run thereon constitute a derailing prevention mechanism, and therefore, it is possible to reliably prevent the derailing of the door rollers and the tilting of the door when the door is opened and closed.

Furthermore, according to this aspect of the present invention, the elastic connection mechanism that connects the drive connection portion for connecting the door to the open-close drive mechanism and the swing members includes an elastic portion, and the elastic connection mechanism is provided so as to be capable of changing the relative positions of the second door roller and the drive connection portion by elastic deformation. Accordingly, at the time of acceleration or deceleration when the door is driven to be opened and closed, the elastic connection mechanism and the swing members are relatively displaced with respect to the door by the elastic deformation of the elastic portion, and the contact pressure exerted on the upper rail from the second door roller is temporarily increased. However, the elastic deformation of the elastic portion is immediately restored when the velocity is constant, and consequently, the distance relationship between the upper rail and the second door roller is brought back to the original state. Further, even if a load is exerted from the door in a direction in which elastic deformation of the elastic portion is caused, as the result of a foreign object having collided with or having been caught at the end of the door in the opening and closing direction, the elastic connection mechanism and the swing members are relatively displaced with respect to the door by the elastic deformation of the elastic portion, and the position of the second door roller with respect to the upper rail is positioned in a suitable position according to the aforementioned load.

Therefore, according to this aspect of the present invention, the second door roller is installed in light contact with the upper rail, and thereby, it is possible to set a state in which running resistance can be sufficiently reduced in a derailing prevention mechanism when the door rollers are running on the rail. Also, at the time of the acceleration/deceleration of the door or the collision with a foreign object, the door rollers can be positioned in suitable positions according to the load, and the derailing of the door rollers and the tilting of the door can be reliably prevented. Note that, according to this aspect of the present invention, the positional adjustment of the second door roller, namely, the degree to which the second door roller is in contact with the upper rail, has little impact on the above-described derailing prevention performance. Accordingly, the positional adjustment requires little time and effort at the time of installing the door suspension device of the present invention, and the installation operation can be performed easily.

Further, according to this aspect of the present invention, the second door roller is installed between the first door roller on the door leading end side and the first door roller on the door trailing end side. For this reason, the second door roller, the swing members, and the elastic connection mechanism can be provided inward of the first door rollers on the door leading end side and the door trailing end side. Thus, a problem will not arise in that the size of the structure is increased as a result of the necessity for installing the second door rollers, the swing members, and the elastic connection mechanism while avoiding the first door rollers due to restriction on the apparatus layout. That is to say, the second door roller, the swing members, and the elastic connection mechanism can be compactly installed inward of the first door rollers on the door leading end side and the door trailing end side, and the structure of the door suspension device can be made compact.

Therefore, according to this aspect of the present invention, it is possible to provide a door suspension device having a compact structure capable of reliably preventing the derailing of door rollers and the tilting of the door when the door is opened and closed, while reducing running resistance caused by the derailing prevention mechanism.

A door suspension device according to the second aspect of the present invention is the door suspension device according to the first aspect of the present invention, wherein the second door roller is provided on both the door leading end side and the door trailing end side with respect to the elastic connection mechanism.

According to this aspect of the invention, the second door roller is provided on both the door leading end side and the door trailing end side with respect to the elastic connection mechanism. For this reason, both during the opening driving and the closing driving of the door, the position of the second door roller with respect to the upper rail can be stably positioned in a suitable position at the time of acceleration/deceleration or when a foreign object has collided with the end of the door. Accordingly, it is possible to realize a door suspension device having a compact structure capable of reliably preventing the derailing of the door rollers and the tilting of the door, while reducing running resistance caused by a derailing prevention mechanism, both during the opening driving and the closing driving of the door.

A door suspension device according to the third aspect of the present invention is the door suspension device according to the first or second aspect of the present invention, wherein a door leading end-side swing member that is connected to the first door roller supporting member on the door leading end side and a door trailing end-side swing member that is connected to the first door roller supporting member on the door trailing end side are provided as the swing members, the elastic connection mechanism includes swingable connection members to which the door leading end-side swing member and the door trailing end-side swing member are rotatably connected, respectively, and the swingable connection members are connected to the drive connection portion via the elastic portion so as to restrict displacement of the drive connection portion with respect to the swingable connection members when the door moves in the closing direction, and so as to be capable of changing a relative position of the drive connection portion with respect to the swingable connection members by elastic deformation of the elastic portion when the door moves in the opening direction.

According to this aspect of the invention, displacement of the drive connection portion with respect to the swingable connection members to which the door leading end-side swing member and the door trailing end-side swing member are rotatably connected, allowed by elastic deformation of an elastic member when the door moves in the opening direction, and is restricted when the door moves in the closing direction. For this reason, an improvement in the responsiveness of the derailing prevention mechanism is achieved at the time of moving of the door in the closing direction during which the derailing of the door rollers and the tilting of the door are more likely caused than at the time of moving of the door in the opening direction. Accordingly, the derailing of the door rollers and the tilting of the door can be further reliably prevented.

A door suspension device according to the fourth aspect of the present invention is the door suspension device according to the first or second aspect of the present invention, wherein a door leading end-side swing member that is connected to the first door roller supporting member on the door leading end side and a door trailing end-side swing member that is connected to the first door roller supporting member on the door trailing end side are provided as the swing members, the elastic connection mechanism includes swingable connection members to which the door leading end-side swing member and the door trailing end-side swing member are rotatably connected, respectively, and that are connected to the drive connection portion via the elastic portion, a door leading end-side swingable connection member to which the door leading end-side swing member is rotatably connected and a door trailing end-side swingable connection member to which the door trailing end-side swing member is rotatably connected are provided as the swingable connection members, a door leading end-side second door roller that is rotatably supported with respect to the door leading end-side swing member and a door trailing end-side second door roller that is rotatably supported with respect to the door trailing end-side swing member are provided as the second door roller, and the door leading end-side swingable connection member and the door trailing end-side swingable connection member are connected to each other via the elastic portion so as to be capable of relatively moving in the opening and closing direction of the door.

According to this aspect of the invention, the door leading end-side swingable connection member connected to the door leading end-side swing member to which the door leading end-side second door roller is supported and the door trailing end-side swingable connection member connected to the door trailing end-side swing member to which the door trailing end-side second door roller is supported are connected to each other via the elastic portion so as to be capable of relatively moving in the opening and closing direction of the door. For this reason, with the operation of the elastic portion, the distance between the door leading end-side second door roller and the door trailing end-side second door roller and the angle of the door leading end-side swing member and the door trailing end-side swing member with respect to the first door roller supporting member in the swing direction are automatically adjusted in accordance with the distance dimension between the upper rail and the lower rail. Accordingly, the second door roller comes into contact with the upper rail automatically at a predetermined contact pressure or less, regardless of the distance dimension between the upper and lower rails, and therefore, the positional adjustment requires no time and effort when the door suspension device is installed, and the installation task can be performed very easily.

A door suspension device according to the fifth aspect of the present invention is the door suspension device according to the fourth aspect of the present invention, wherein the drive connection portion is provided with a contact portion capable of coming into contact with at least one of the door leading end-side swingable connection member and the door trailing end-side swingable connection member, and displacement of the drive connection portion with respect to the swingable connection members is restricted in a predetermined distance range as a result of the contact portion coming into contact with at least one of the door leading end-side swingable connection member and the door trailing end-side swingable connection member.

According to this aspect of the invention, the displacement of the drive connection portion with respect to the swingable connection members is restricted in a predetermined distance range as a result of the contact portion of the drive connection portion coming into contact with at least one of the door leading end-side and door trailing end-side swingable connection members. For this reason, the derailing prevention mechanism can be reliably operated at the stage where the displacement of the drive connection portion with respect to the swingable connection members reaches the predetermined distance, regardless of the amount of the elastic deformation of the elastic portion.

A door suspension device according to the sixth aspect of the present invention is the door suspension device according to any of the first to fifth aspects of the present invention, wherein the drive connection portion includes a slide member installed so as to be slidably moved with respect to the first door roller supporting member, and a connection member that is formed separately from the slide member and connected to the open-close drive mechanism, and the connection member is provided so as to be attachable to the slide member on both the door leading end side and the door trailing end side, and holds one end of the elastic portion or one end of a shaft-like member biased by the elastic portion.

According to this aspect of the invention, the connection member of the drive connection portion that is connected to the open-close drive mechanism and holds an end of the elastic portion or of a shaft-like portion biased by the elastic portion is provided so as to be attachable to the slide member on both the door leading end side and the door trailing end side. For this reason, the same parts including the slide member, the connection member, and the elastic portion can be used for both a right-handed door and a left-handed door. Thus, the parts can be easily managed.

A door suspension device according to the seventh aspect of the present invention is the door suspension device according to any of the first to sixth aspects of the present invention, wherein the first door roller supporting member has a dent portion having a cutout shape so as to free a space around an axle to which the second door roller is rotatably supported with respect to the swing members and allow the swing members to pivot.

According to this aspect of the invention, the first door roller supporting member has a dent portion having a cutout shape that frees the space around the axle of the second door roller so as to allow the swing members to pivot. For this reason, a configuration can be realized in which the second door roller and the swing members are closely installed, and the first door roller and the first door roller supporting member are closely installed. Thus, the door suspension device can be made more compact.

A door suspension device according to the eighth aspect of the present invention is the door suspension device according to any of the first to seventh aspects of the present invention, wherein in the first door roller and the second door roller, at least a first rolling surface of the first door roller that rolls on the running surface of the lower rail and a second rolling surface of the second door roller that rolls on the running surface of the upper rail have the same shape, the first rolling surface and the second rolling surface are each provided with a pair of outer rolling surfaces formed as convex curved surfaces that project on the outside in a direction parallel to a rotation center line of the first door roller and the second door roller, and an inner rolling surface formed as a concave curved face on the inside of the pair of outer rolling surfaces in the direction parallel to the rotation center line, the pair of outer rolling surfaces of one of the first door roller and the second door roller come into contact with one of the upper rail and the lower rail, and the inner rolling surface of the other of the first door roller and the second door roller comes into contact with the other of the upper rail and the lower rail, and one of the upper rail and the lower rail is provided with a projection that projects between the pair of outer rolling surfaces of the one of the first door roller and the second door roller.

According to this aspect of the invention, in the first door roller and the second door roller, at least the first rolling surface has the same shape as the second rolling surface, and therefore, the parts of the first door roller and the second door roller can be easily managed. Further, the outer rolling surfaces, which are a pair of convex curved surfaces, of one of the first and second door rollers come into contact with one of the upper and lower rails, and the inner rolling surface, which is a concave curved surface, of the other of the first and second door rollers comes into contact with the other of the upper and lower rails. Furthermore, the one of the upper and lower rails is provided with the projection that projects between the pair of outer rolling surfaces that come in contact with the one of the upper and lower rails. For this reason, even if the first and second door rollers tilt between the upper and lower rails in the direction perpendicular to the rail lengthwise direction, the first and second door rollers are further reliably prevented from derailing from the rail.

A door suspension device of the ninth aspect of the present invention is the door suspension device according to the eighth aspect of the present invention, wherein the pair of outer rolling surfaces of the second door roller come into contact with the upper rail, and the inner rolling surface of the first door roller comes into contact with the lower rail.

According to this aspect of the invention, the pair of the outer rolling surfaces of the second door roller come into contact with the upper rail, the inner rolling surface of the first door roller comes into contact with the lower rail, and the projection of the upper rail projects between the pair of outer rolling surfaces of the second door roller. For this reason, even in the case of a door in an overhanging state in which the door is suspended while tilting toward the side of the rail, a state in which the running resistance of the second door roller is sufficiently reduced is maintained in a range in which the second door roller tilts while the pair of outer rolling surfaces do not come into contact with the projection of the upper rail. That is to say, even in the case of the doors in an overhanging state, the tilting of the door rollers is efficiently absorbed, and a state in which the running resistance of the second door roller is sufficiently reduced is maintained.

According to another aspect of the present invention, it is possible to configure a door apparatus provided with any of the above-described door suspension devices. That is to say, a door suspension device according to the tenth aspect of the present invention is a door apparatus comprising: the door suspension device according to any of the first to ninth aspects, a door that is provided in a structure and is supported by the door suspension device in a state of being suspended to the structure so as to be slidably moved; and an open-close drive mechanism that is connected to the door suspension device and drives the door to be opened and closed.

According to this aspect of the invention, it is possible to provide a door apparatus having a compact structure capable of reliably preventing the derailing of door rollers and the tilting of door when the door is opened and closed, while reducing running resistance caused by a derailing prevention mechanism.

Effects of the Invention

According to the present invention, it is possible to provide a door suspension device capable of reliably preventing the derailing of door rollers and the tilting of doors when the doors are opened and closed, while reducing running resistance caused by a derailing prevention mechanism, and is also possible to provide a door apparatus including the door suspension device.

DESCRIPTION OF EMBODIMENTS

Hereinafter, modes for carrying out the present invention will be described with reference to the drawings. The present invention can be used as a door suspension device that supports a door provided in a structure and driven to be opened and closed by an open-close drive mechanism, in a state in which the door is suspended to the structure so as to be slidably moved, and that is connected to the open-close drive mechanism, and a door apparatus provided with the door suspension device. Although this embodiment will be described, taking, as an example, a door suspension device and a door apparatus that are used in a railroad vehicle, the present invention is not limited to this example and is widely applicable as a door suspension device and a door apparatus that can be provided in a variety of structures.

Figure 1:
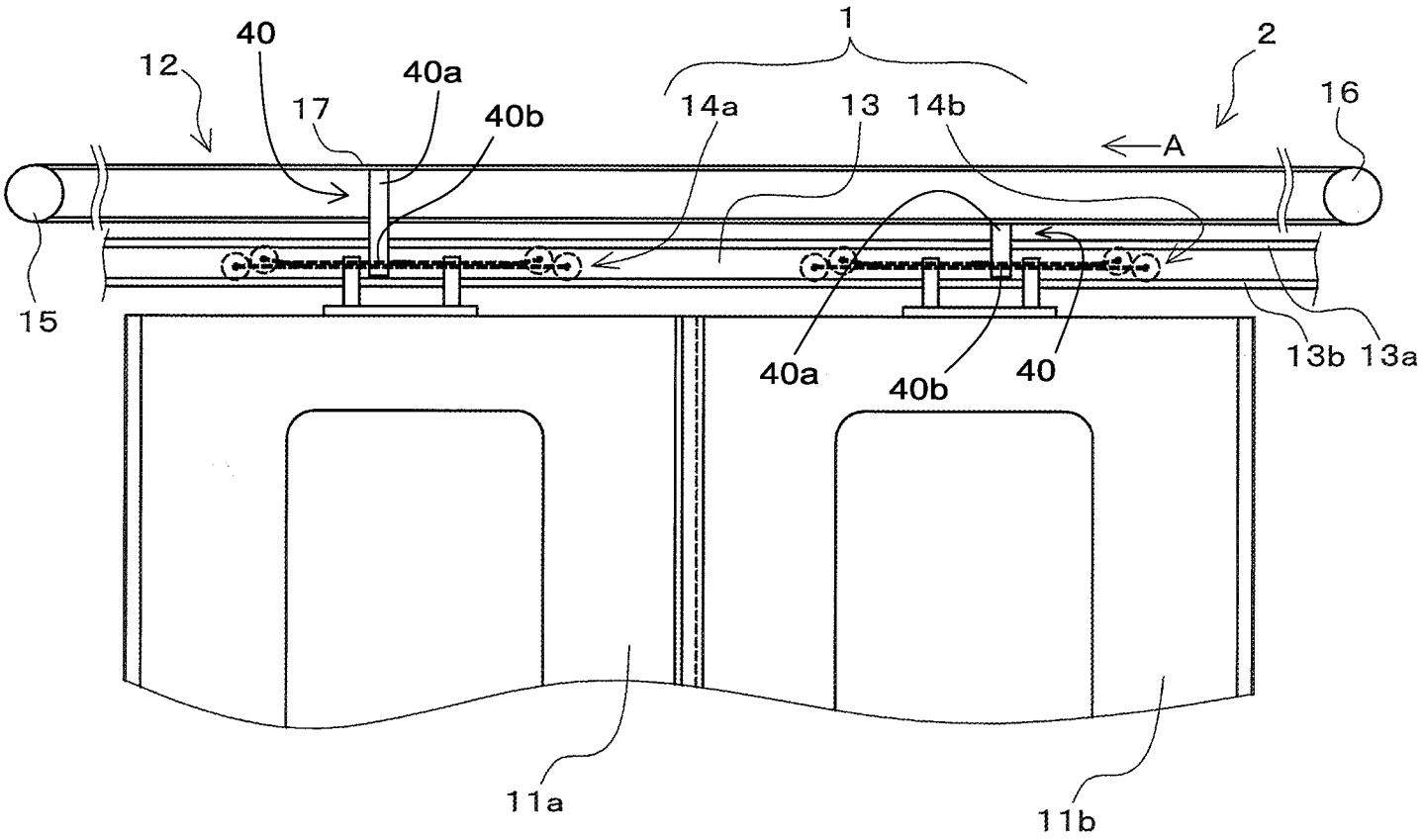
FIG. 1 is a front view schematically showing a door apparatus according to an embodiment of the present invention.

FIG. 1 is a front view schematically showing a door apparatus 2 according to an embodiment of the present invention. The door apparatus 2 shown in FIG. 1 can be used, for example, for a side wall of a railroad vehicle as a structure. Note that FIG. 1 shows a front view of the door apparatus 2, as viewed from the inside of the railroad vehicle. In addition, the side wall of the railroad vehicle is omitted in FIG. 1. The door apparatus 2 includes door suspension devices 1 according to an embodiment of the present invention, doors 11 (partly shown in FIG. 1), an open-dose drive mechanism 12, and so forth.

The doors 11 are configured as sliding doors provided at a side wall of a railroad vehicle (hereinafter, referred to as a "structure"), are installed along the vertical direction, and constitute side doors provided in the railroad vehicle for loading and unloading of passengers. In the door apparatus 2, two doors, namely, a door 11*a* and a door 11*b*, are provided as the doors 11. Also, the doors 11 (11*a*, 11*b*) are supported by the door suspension devices 1, which will be described below, in a state in which it is suspended to the structure so as to be slidably moved. Note that rails 13 of the door suspension devices 1 are fixed to the structure in a state in which they are disposed extending linearly in the horizontal direction. The door 11*a* and the door 11*b* are supported by door roller mechanisms 14, which will be described below, of the respective door suspension devices 1 at their upper ends, and are configured to be closed by approaching each other along the rail 13 and coming into contact and to be opened by moving away from each other.

The open-close drive mechanism 12 is installed in the structure, and is provided as a mechanism that is connected to the door suspension devices 1 and that drives the doors 11 (11*a*, 11*b*) to be opened and closed. The open-close drive mechanism 12 shown as an example in FIG. 1 includes a drive motor (not shown), a drive pulley 15, a driven pulley 16, a belt 17, and so forth. The belt 17 is configured as an endless belt that is wound around the drive pulley 15 and the driven pulley 16 in a freely rotatable manner. Rotation of the drive pulley 15 connected to the drive motor causes the belt 17 wound around the drive pulley 15 to be rotated, thus causing the driven pulley 16 to rotate together with the belt 17.

Figure 2:
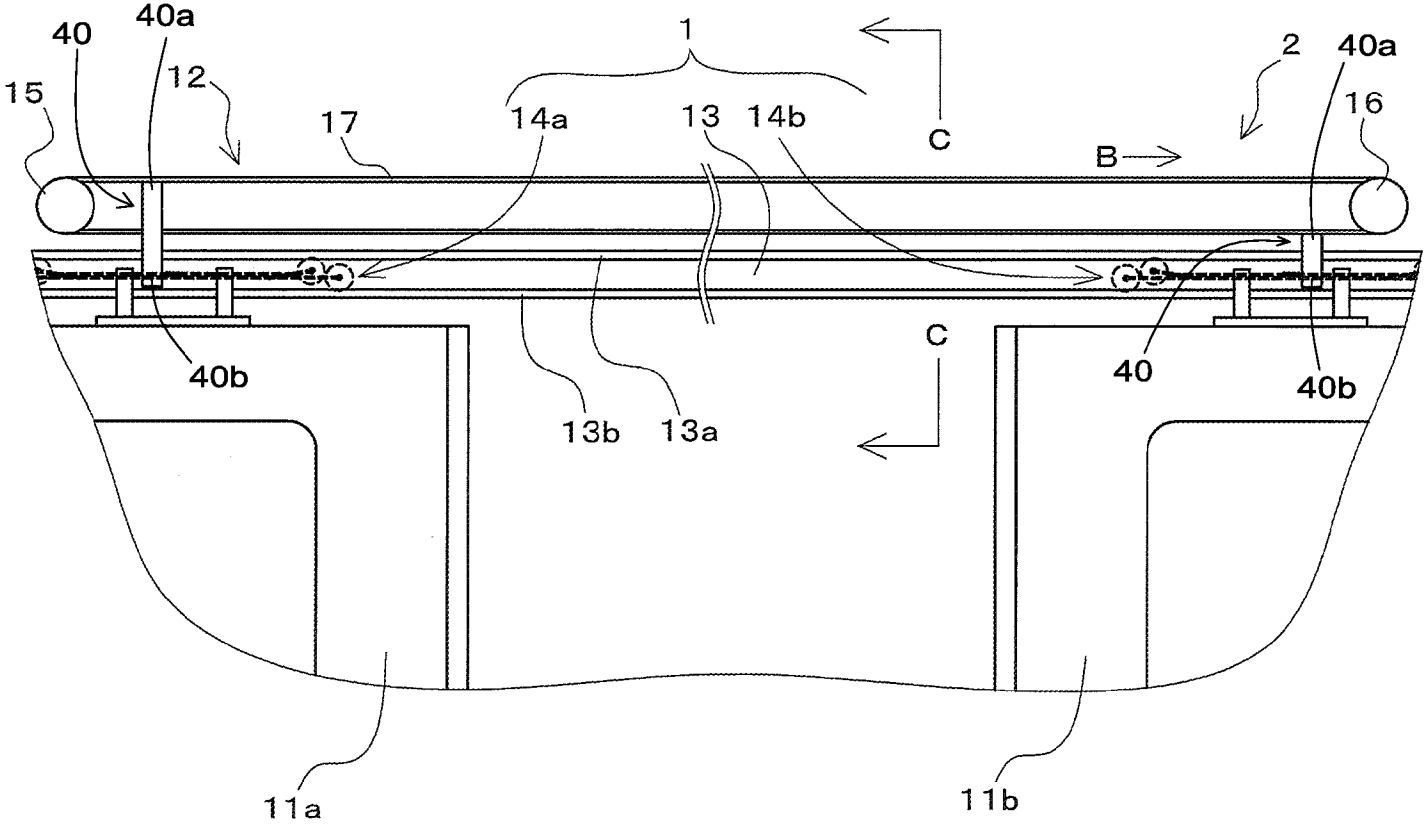
FIG. 2 is a front view schematically showing a state in which doors are opened in the door apparatus shown in FIG. 1.

The drive motor is controlled to be rotated by a predetermined amount in forward and reverse directions, in accordance with a command from a controller, which is not shown. Accordingly, the doors 11 (11*a*, 11*b*) that are supported in a state in which they are suspended via the door suspension devices 1 connected to the belt 17 of the open-close drive mechanism 12 are driven in the opening direction and the closing direction. Note that FIG. 1 shows the state of a fully closed position in which the two doors 11 (11*a*, 11*b*) are closed, and FIG. 2 shows the state of a fully opened position in which the two doors 11 are opened. By operating the open-close drive mechanism 12 such that the belt 17 is rotated in the direction indicated by the arrow A in FIG. 1, door roller mechanisms (14*a*, 14*b*), which will be described below, of the door suspension devices 1 are moved in directions away from each other, and the state of the two doors 11 (11*a*, 11*b*) is shifted to the state of the fully opened position shown in FIG. 2. On the other hand, by operating the open-close drive mechanism 12 such that the belt 17 is rotated in the direction indicated by the arrow B shown in FIG. 2, the door roller mechanisms (14*a*, 14*b*) are moved in directions approaching each other, and the state of the two doors 11 (11*a*, 11*b*) is shifted to the state of the fully closed position shown in FIG. 1.

Although the present embodiment describes the mechanism including the drive motor, the drive pulley, the driven pulley, and the belt as an example of the open-close drive mechanism, this need not be the case, and various modifications may be implemented as long as the mechanism is provided in a structure and can drive the doors to be opened and closed. For example, a door apparatus may be implemented that includes an open-close drive mechanism including a drive motor, a pinion that is driven to rotate by the drive motor, upper and lower racks that are meshed with the pinion, installed parallel to each other so as to be capable of reciprocating with rotation of the pinion, and are connected to the door suspension device, and so forth. Alternatively, a door apparatus may be implemented that includes an open-close drive mechanism including a drive motor, a screw shaft that is driven to rotate by the drive motor, a nut member that is screwed with the screw shaft and is connected to the door suspension device, and so forth.

Figure 3:
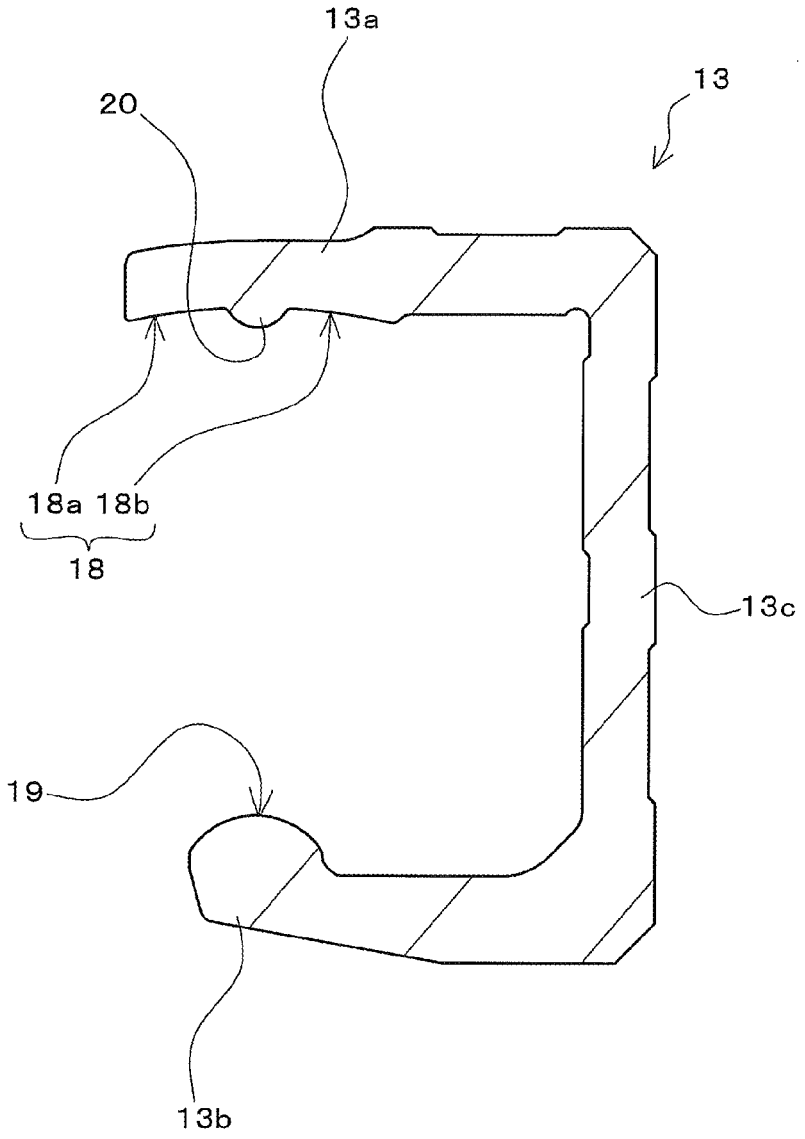
FIG. 3 is a cross-sectional view of a rail of the door apparatus shown in FIG. 2, as viewed from the position of the arrows C-C.

As shown in FIGS. 1 and 2, a door suspension device 1 includes a rail 13 and door roller mechanisms 14 (14*a*, 14*b*). FIG. 3 is a cross-sectional view of the rail 13, as viewed from the position of the arrows C-C in FIG. 2. The rail 13 shown in FIGS. 1 to 3 is fixed to the structure and includes an upper rail 13*a* and a lower rail 13*b* that are respectively provided with vertically opposed running surfaces (18, 19). The upper rail 13*a* and the lower rail 13*b* extend linearly in the horizontal direction, and are formed integrally via a bridging portion 13*c* of the rail 13.

The running surface 18 of the upper rail 13*a* is provided as a pair of dented running surfaces (18*a*, 18*b*) that horizontally extend in parallel. The cross section of the pair of dented running surfaces (18*a*, 18*b*) is formed so as to be bent in an arc shape, and are formed so as to be bent such that the dented running surfaces (18*a*, 18*b*) are gradually dented upward. The upper rail 13*a* is provided with a projection 20 that projects downward between the pair of dented running surfaces (18*a*, 18*b*). This projection 20 is formed so as to horizontally extend between the pair of dented running surfaces (18*a*, 18*b*) and such that its cross section bulges downward in an arc shape. On the other hand, the cross section of the running surface 19 of the lower rail 13*b* is formed so as to oppose the running surface 18 of the upper rail 13*a* and bulge upward in an arc shape.

Although the present embodiment is described taking, as an example, the rail including the upper rail and the lower rail that are integrated, this need not be the case. That is to say, a rail may be implemented that includes an upper rail and a lower rail that are formed and installed separately, or rails may be implemented that are formed as separate parts and coupled to each other via another member.

As shown in FIGS. 1 and 2, the door roller mechanisms 14 (14*a*, 14*b*) are provided in one-to-one correspondence with the doors (11*a*, 11*b*), and are each connected to the belt 17 of the open-close drive mechanism 12. Also, the door roller mechanism 14*a* supports the door 11*a* in a state in which the door 11*a* is suspended to the structure so as to be slidably moved, and the door roller mechanism 14*b* supports the door 11*b* in a state in which the door 11*b* is suspended to the structure so as to be slidably moved.

Figure 4:
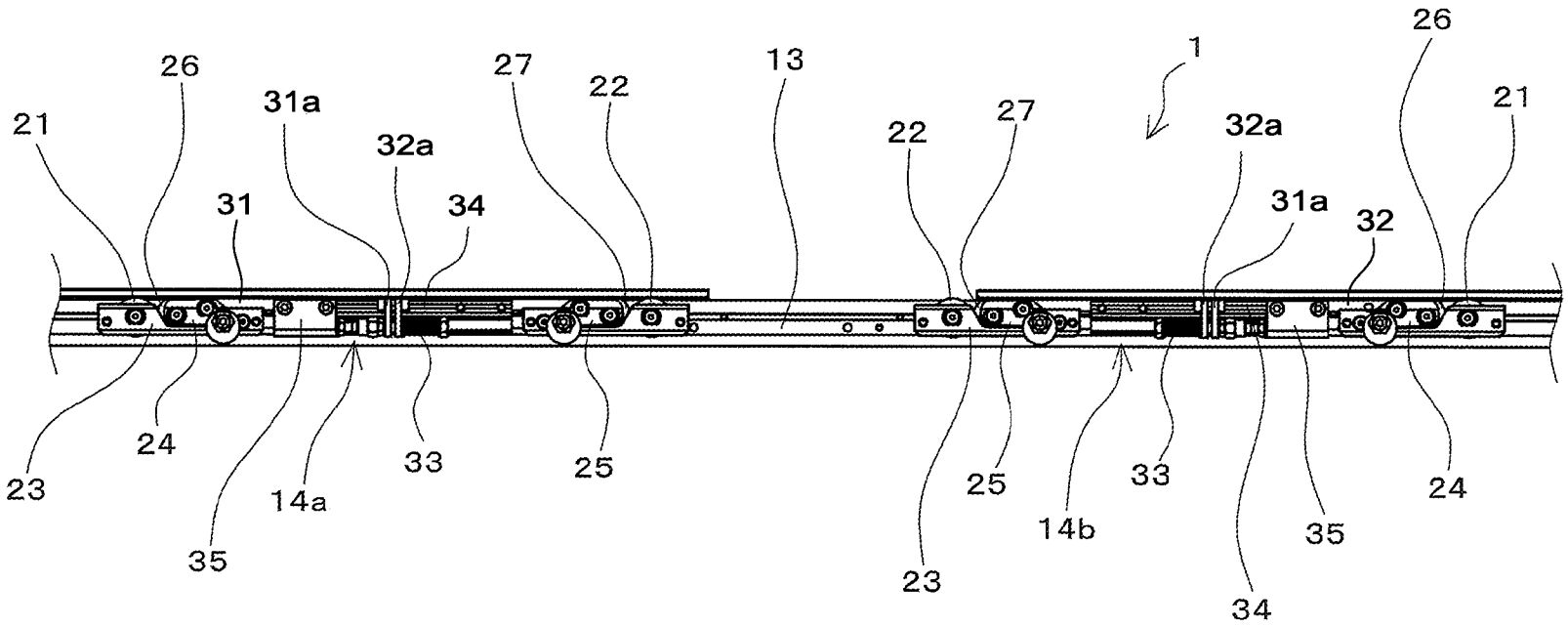
FIG. 4 is a front view showing a door suspension device of the door apparatus shown in FIG. 1.
Figure 5:
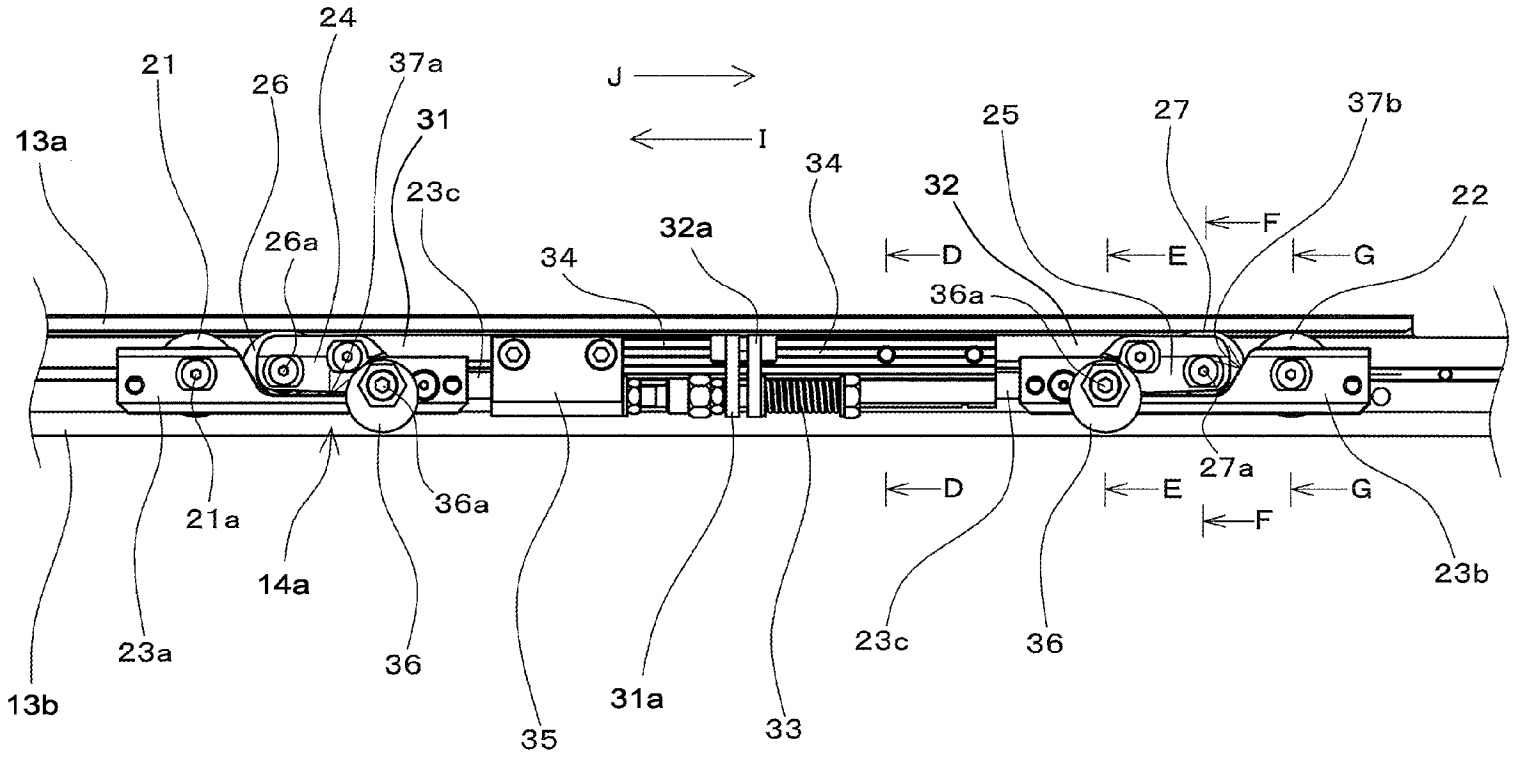
FIG. 5 is an enlarged view of a part of FIG. 4.
Figure 6:
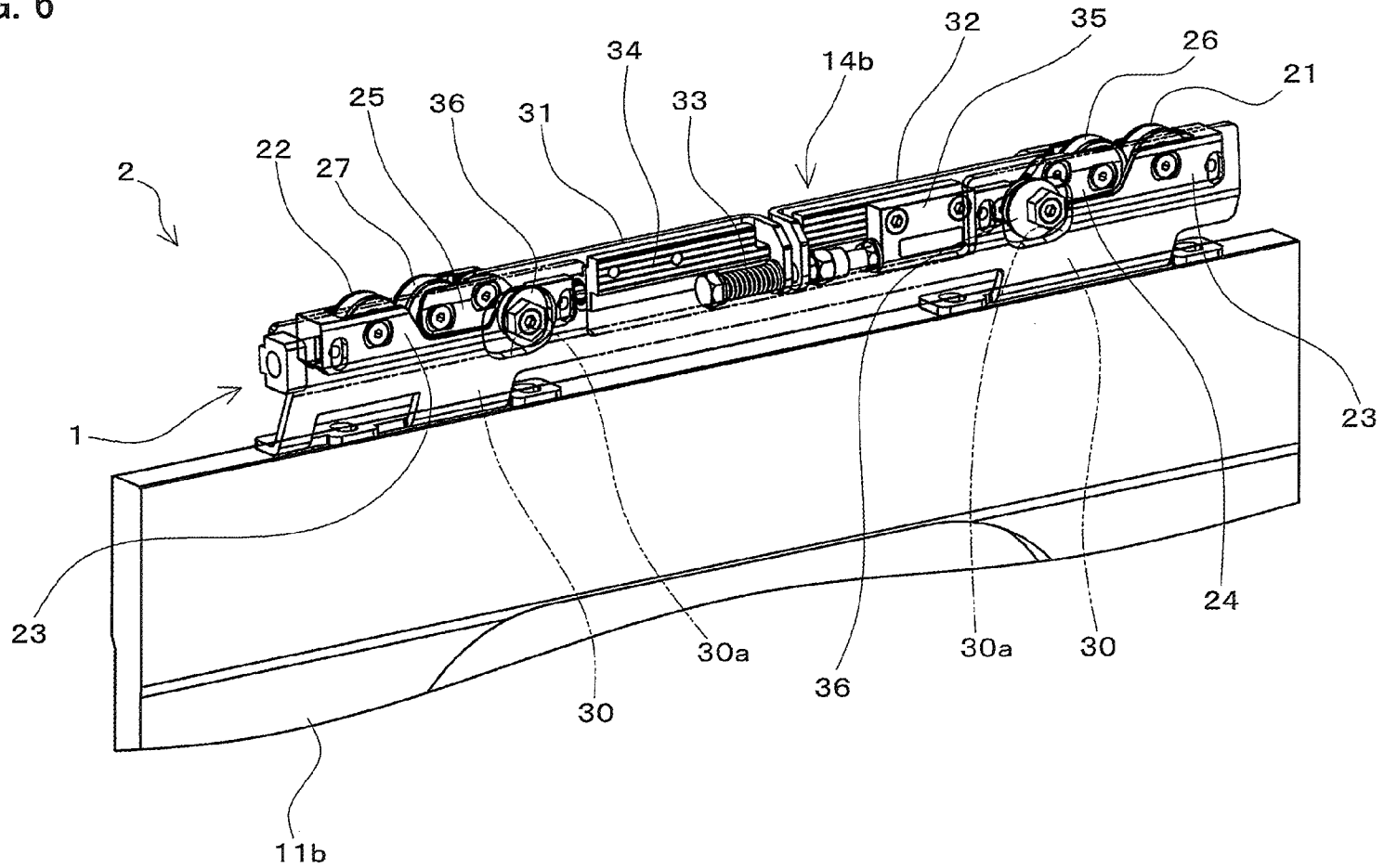
FIG. 6 is a perspective view showing a part of the door apparatus shown in FIG. 1 as viewed from the front.
Figure 7:
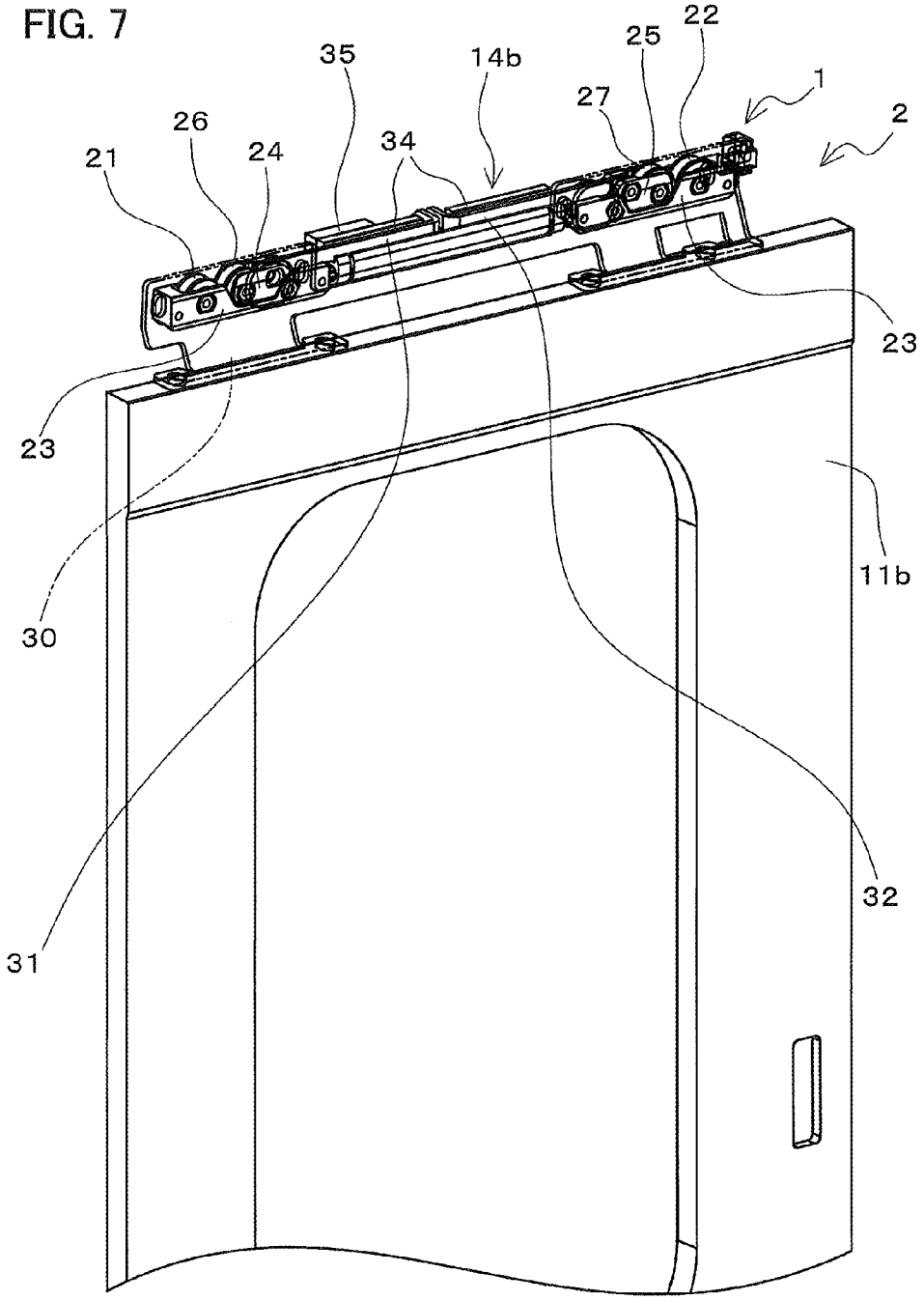
FIG. 7 is a perspective view showing a part of the door apparatus shown in FIG. 1 as viewed from the back.
Figure 8:
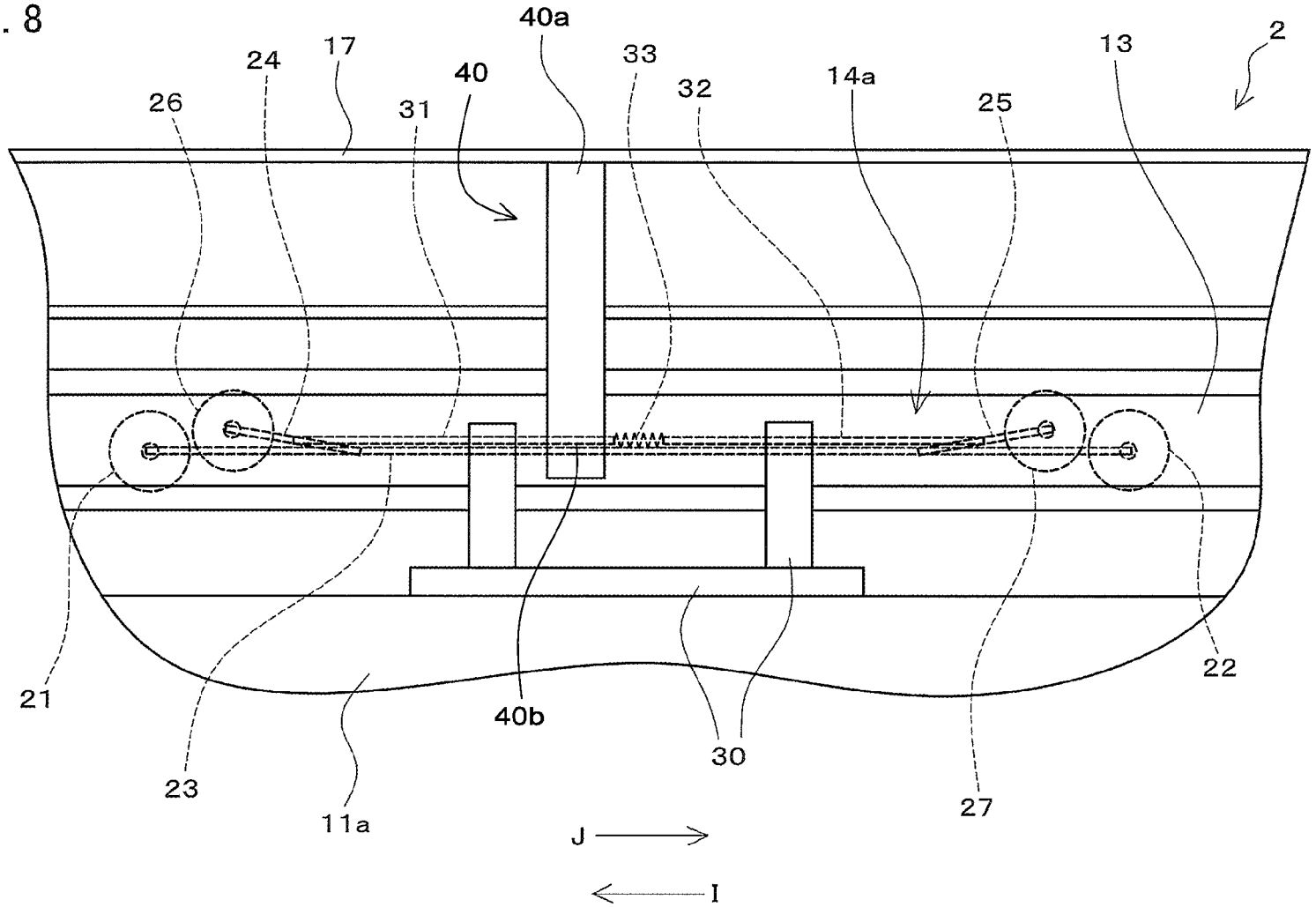
FIG. 8 is an enlarged view of a part of FIG. 1.

FIG. 4 is a front view showing the door suspension device 1 of the door apparatus 2 as viewed from the inside of the railroad vehicle. FIG. 5 is an enlarged view of a part of FIG. 4, and shows an enlargement of the door roller mechanism 14*a* and the vicinity thereof. FIG. 6 is a perspective view showing a part of the door apparatus 2 as viewed from the front (i.e., as viewed from the inside of the railroad vehicle), and shows the door roller mechanism 14*b* and a part of the door 11*b*. FIG. 7 is a perspective view showing a part of the door apparatus 2 as viewed from the back (i.e., as viewed from the outside of the railroad vehicle), and shows the door roller mechanism 14*b* and a part of the door 11*b*. FIG. 8 is an enlarged view of a part of FIG. 1, and shows enlargement of the door roller mechanism 14*a* and the vicinity thereof.

As clearly shown in FIGS. 4 to 8, each door roller mechanism (14*a*, 14*b*) includes a plurality of first door rollers (21, 22), a first door roller supporting member 23, a plurality of swing members (24, 25), a plurality of second door rollers (26, 27), a drive connection portion 28, an elastic connection mechanism 29, a hanger 30, and so forth. Note that the door roller mechanism 14*a*, which is disposed on the drive pulley 15 side and connected to the door 11*a*, and the door roller mechanism 14*b*, which is disposed on the driven pulley 16 side and connected to the door 11*b*, include similar device elements, as described above. The door roller mechanism 14*a* and the door roller mechanism 14*b* are configured in a similar manner, except that they are disposed such that the devices thereof are symmetric about the intermediate position between the two doors 11, and that the length of a portion of the drive connection portion 28 that is connected to the belt 17 is different.

Figure 9:
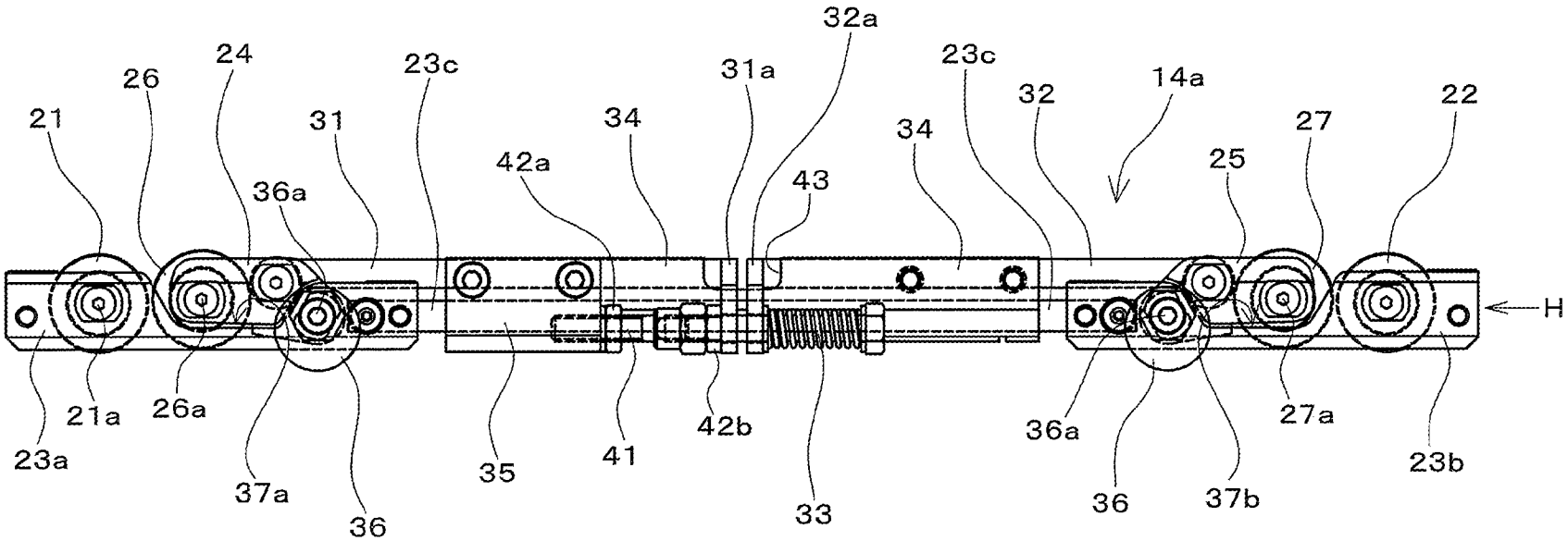
FIG. 9 is a front view showing a door roller mechanism of the door suspension device shown in FIG. 5.
Figure 10:
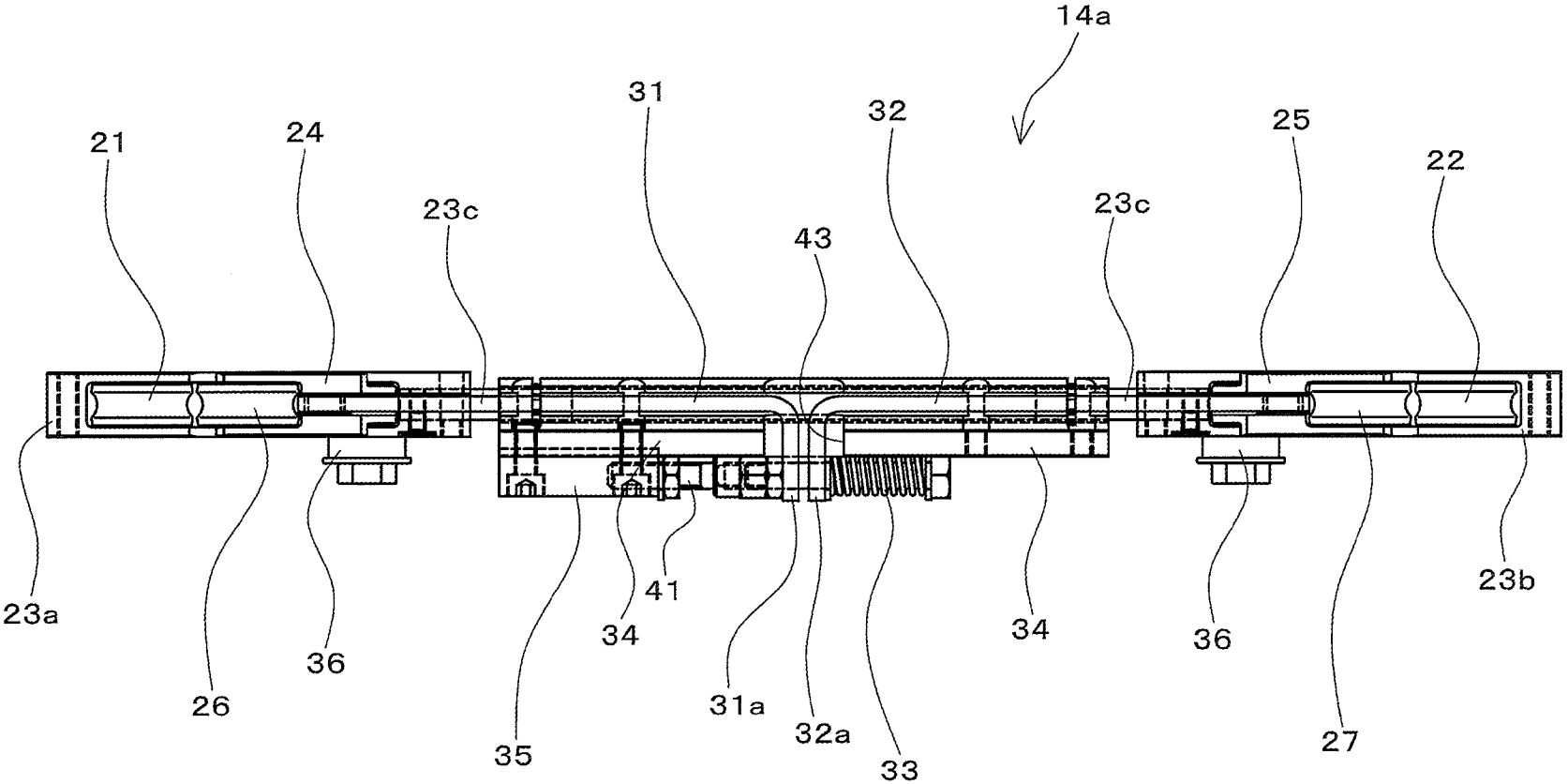
FIG. 10 is a plan view of the door roller mechanism shown in FIG. 9.
Figure 11:
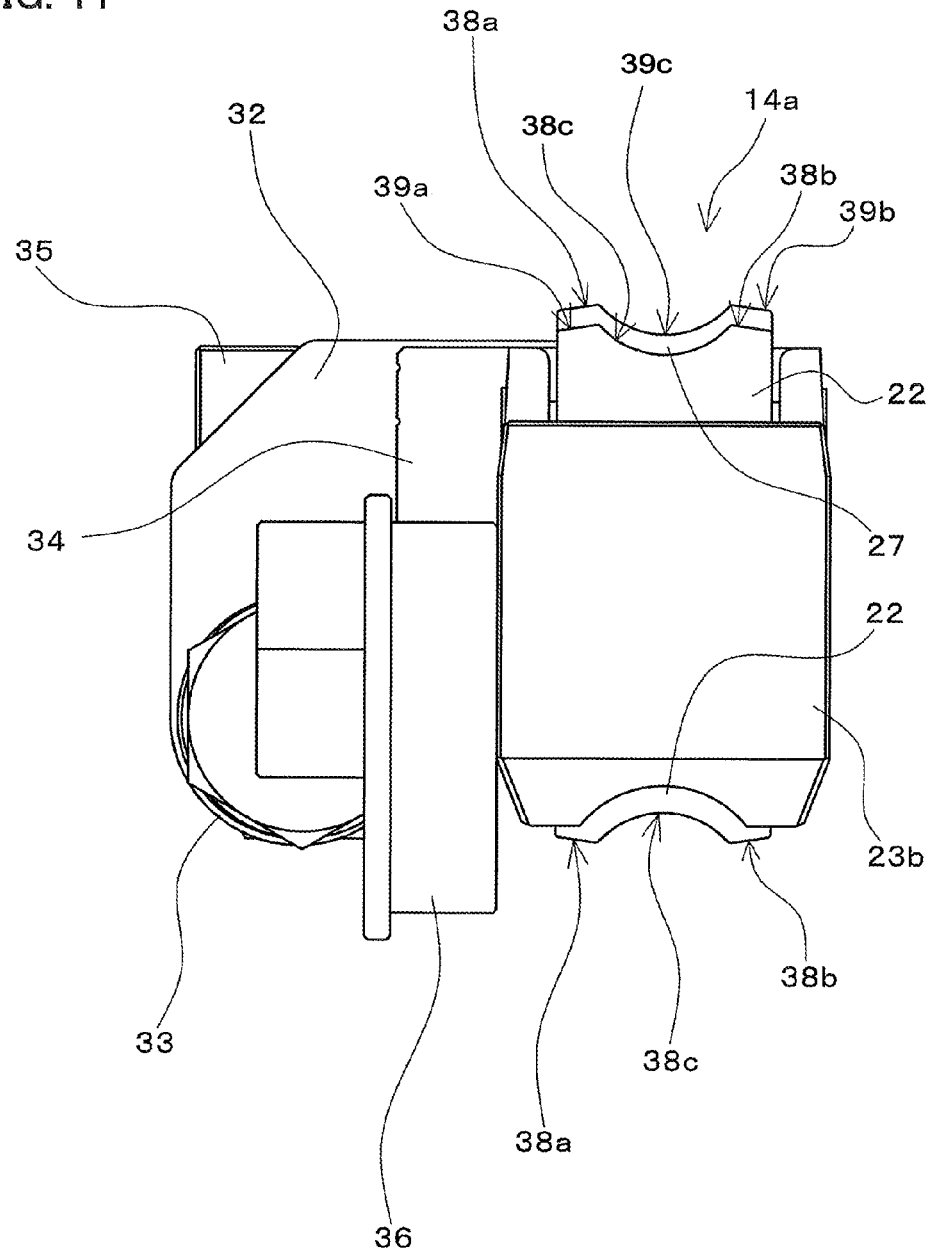
FIG. 11 is a side view of the door roller mechanism shown in FIG. 9.
Figure 12:
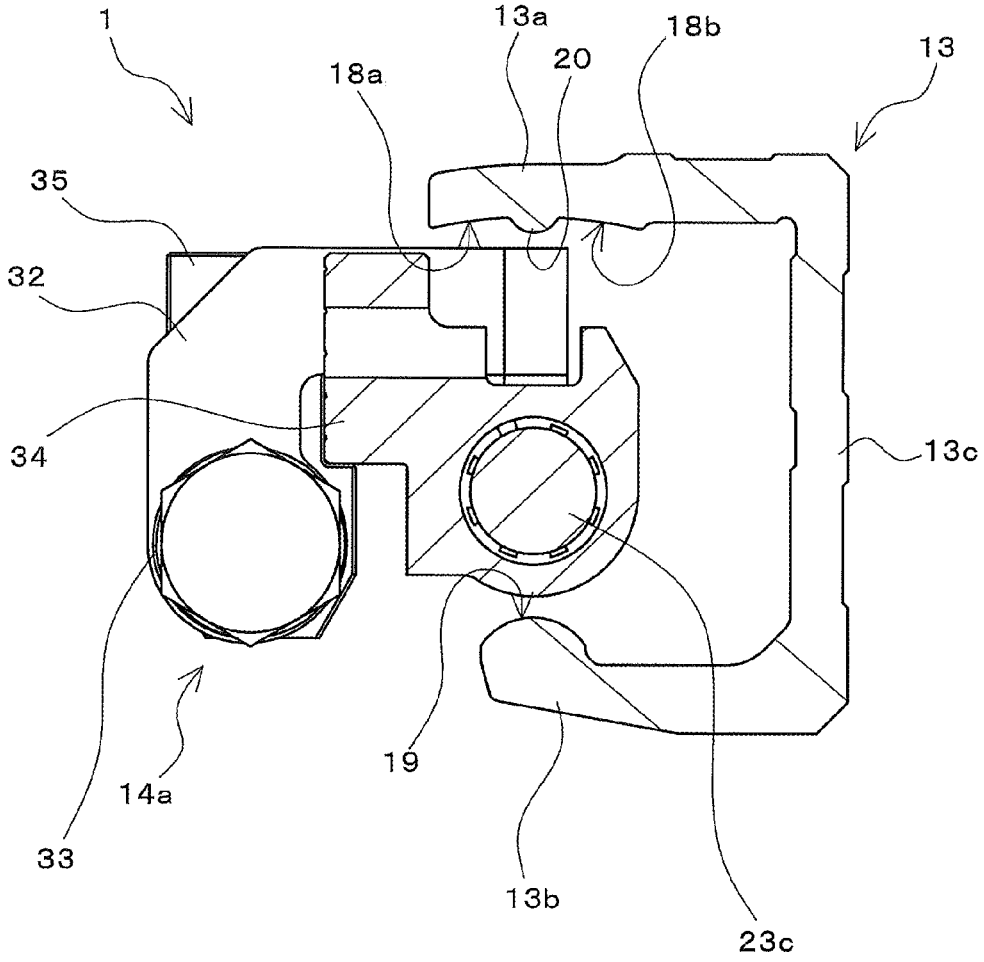
FIG. 12 is a cross-sectional view showing a cross section as viewed from the position of arrows D-D in FIG. 5.
Figure 13:
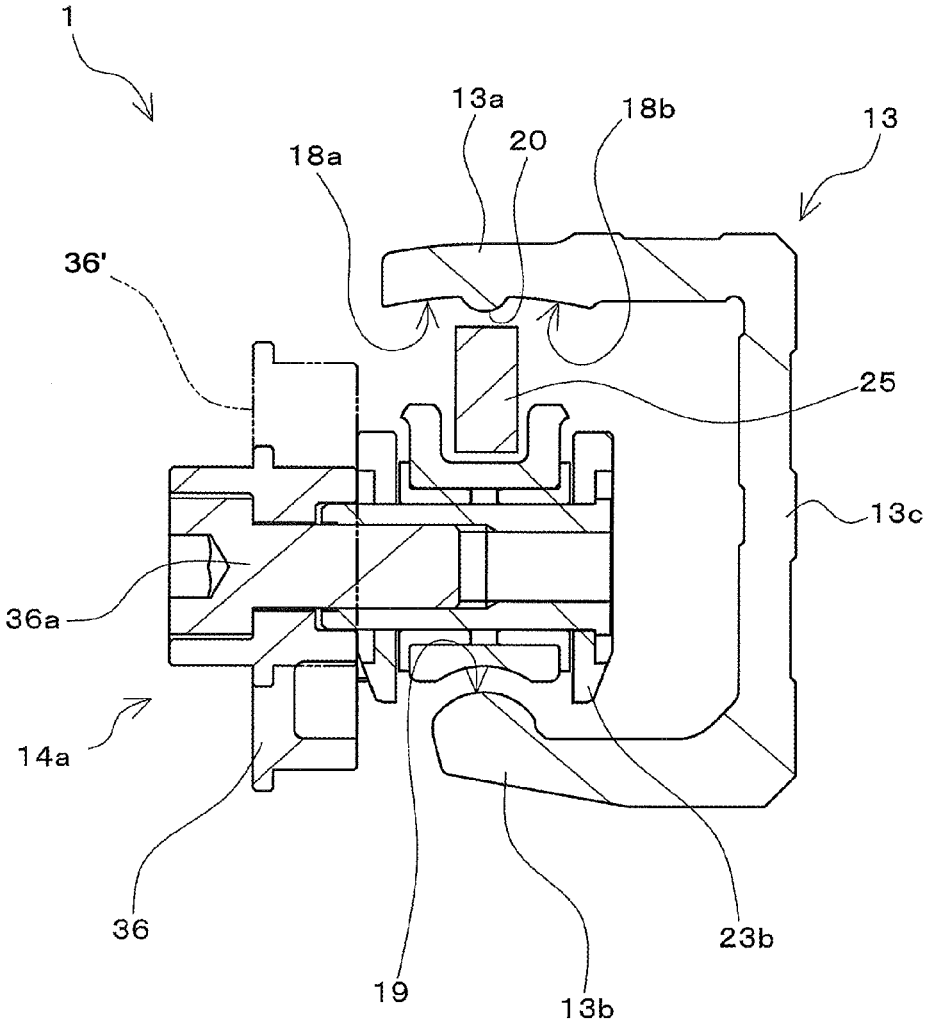
FIG. 13 is a cross-sectional view showing a cross section as viewed from the position of arrows E-E in FIG. 5.
Figure 14:
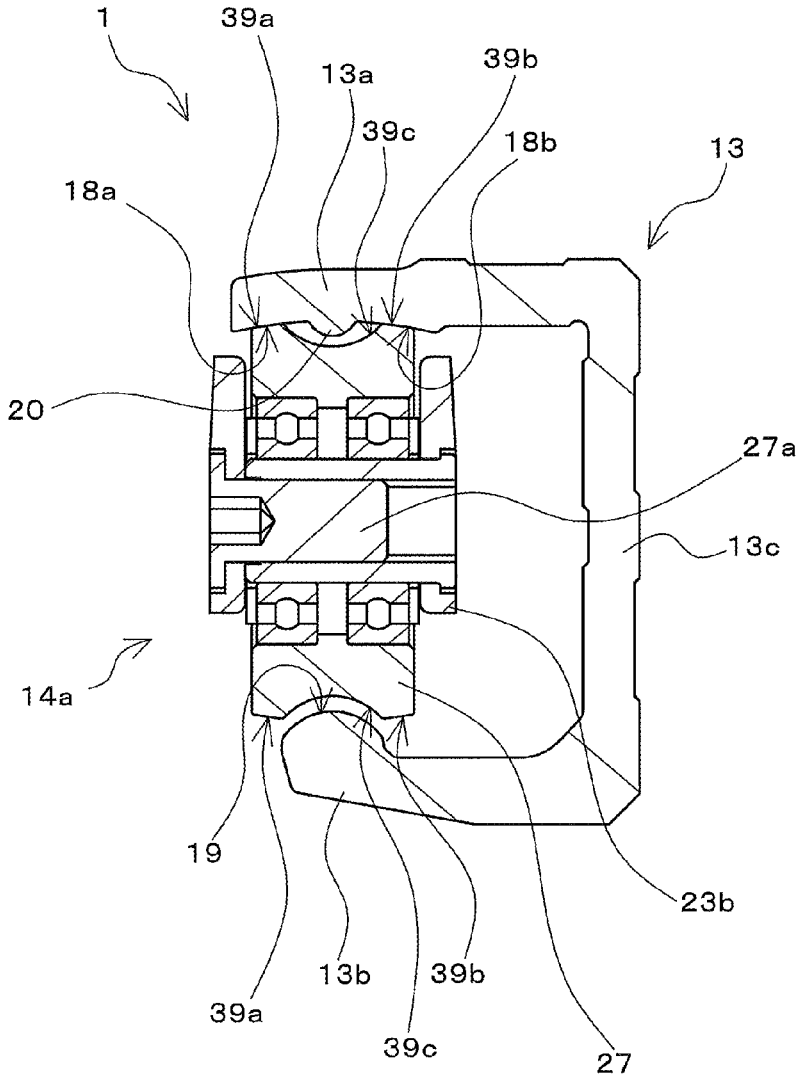
FIG. 14 is a cross-sectional view showing a cross section as viewed from the position of arrows F-F in FIG. 5.
Figure 15:
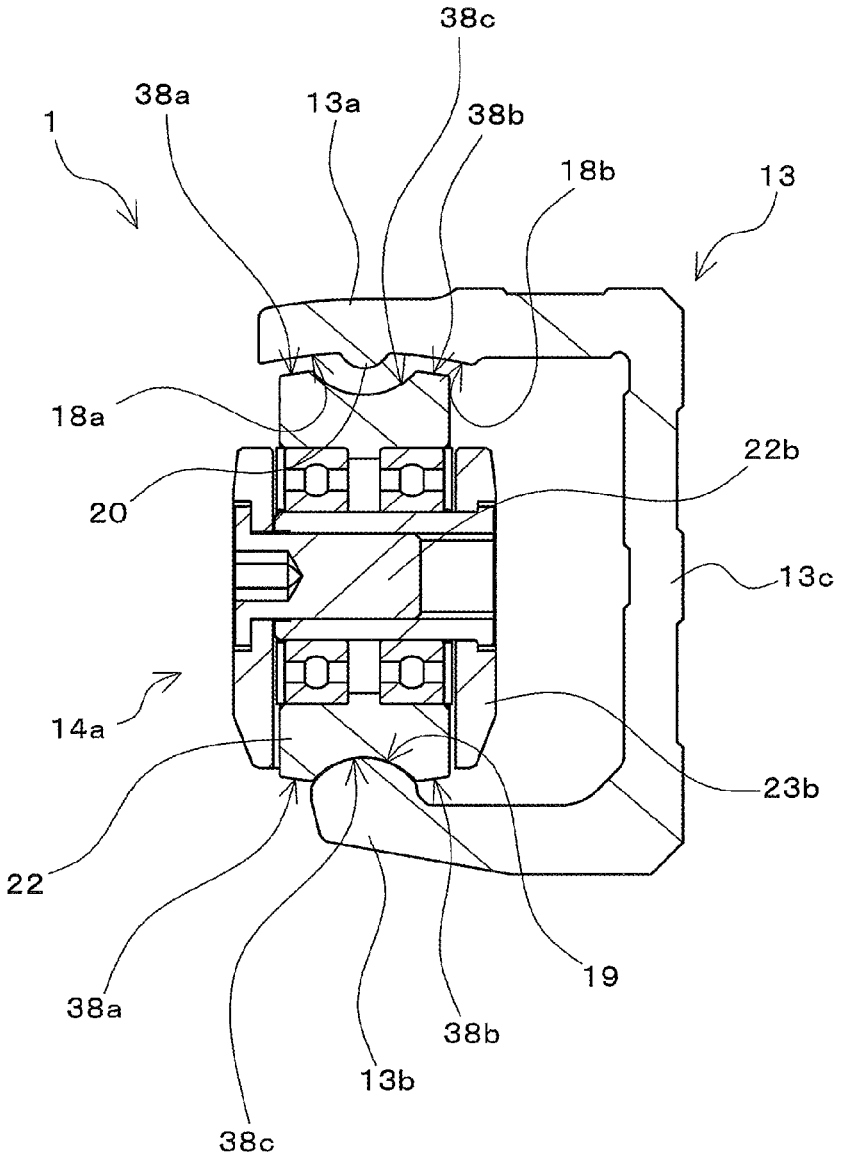
FIG. 15 is a cross-sectional view showing a cross section as viewed from the position of arrows G-G in FIG. 5.

FIG. 9 is a front view showing the door roller mechanism 14*a*. FIG. 10 is a plan view showing the door roller mechanism 14*a*. FIG. 11 is a side view of the door roller mechanism 14*a* as viewed from the direction of the arrow H in FIG. 9. FIG. 12 is a cross-sectional view showing a cross section as viewed from the position of arrows D-D in FIG. 5. FIG. 13 is a cross-sectional view showing a cross section as viewed from the position of arrows E-E in FIG. 5. FIG. 14 is a cross-sectional view showing a cross section as viewed from the position of arrows F-F in FIG. 5. FIG. 15 is a cross-sectional view showing a cross section as viewed from the position of arrows G-G in FIG. 5. Since the door roller mechanism 14*a* and the door roller mechanism 14*b* are configured in a similar manner as described above, a description will be given below for the door roller mechanism 14*a* with reference to FIGS. 5 and 8 to 15, and the door roller mechanism 14*b* will not be described. Note that the door roller mechanism 14*b* will also be mentioned as needed, with reference to FIGS. 6 and 7.

As shown in FIGS. 5, 8 to 11, and 15, the first door rollers (21, 22) are provided as door rollers that run in contact with the running surface 19 of the lower rail 13*b*. The first door rollers (21, 22) are disposed in positions that are substantially line-symmetric about an imaginary center line (hereinafter, referred to as the "center line of the door roller mechanism 14*a*") extending vertically through the central position of the door roller mechanism 14*a* in a direction parallel to the lengthwise direction of the rail 13.

A door trailing end-side first door roller 21 and a door leading end-side first door roller 22 are provided as the first door rollers (21, 22). The door trailing end-side first door roller 21 is provided on a door trailing end side, which is the side on which the end of the door 11*a* in an opening direction (the direction indicated by the arrow I in FIGS. 5 and 8) is located, with respect to the center line of the door roller mechanism 14*a*. On the other hand, the door leading end-side first door roller 22 is provided on a door leading end side, which is the side on which the end of the door 11*a* in the closing direction (the direction indicated by the arrow J in FIGS. 5 and 8) is located, with respect to the center line of the door roller mechanism 14*a*. Thus, the first door roller (21, 22) is provided on both the door leading end side, which is the side on which the end of the door 11*a* in the closing direction is located, and the door trailing end side, which is the side on which the end of the door 11*a* in the opening direction is located, with respect to the first door roller supporting member 23, which will be described below.

The first door roller supporting member 23 shown in FIGS. 5 and 8 to 15 is provided as a member that suspends the door 11*a* via the hanger 30 and rotatably supports the first door rollers (21, 22). Note that this embodiment describes, as an example, a first door roller supporting member 23 including a door trailing end-side member 23*a* that supports the door trailing end-side first door roller 21, a door leading end-side member 23*b* that supports the door leading end-side first door roller 22, and a coupling shaft member 23*c* that fixes these two members at both ends and couples them integrally, and that is formed into a long and narrow cylindrical shaft shape, and thereby all the members are coupled together so as to extend along a line. The first door roller supporting member 23 is installed parallel to the lengthwise direction of the rail 13. On the door trailing end-side member 23*a* of the first door roller supporting member 23, the door trailing end-side first door roller 21 is rotatably supported via an axle 21*a*. On the door leading end-side member 23*b* of the first door roller supporting member 23, the door leading end-side first door roller 22 is rotatably supported via an axle 22*b*.

As shown in the schematic view in FIG. 8, the hanger 30 is provided as a mechanism for suspending the door 11*a* to the first door roller supporting member 23. Here, the hanger 30 of the door roller mechanism 14*b* will be described with reference to FIGS. 6 and 7. The hanger 30 shown in FIGS. 6 and 7 is formed by bending or punching a flat plate member, for example. The hanger 30 is provided with a portion connected and fixed to the upper end of the door 11*b* and a portion attached to the first door roller supporting member 23. A plurality of suspension holes (30*a*, 30*a*) are formed in the portion of the hanger 30 that is attached to the first door roller supporting member 23.

The suspension holes 30*a* formed in the hanger 30 are each provided as an elongated through hole. A plurality of adjustment cams (36, 36) that are rotatably attached to the first door roller supporting member 23 are inserted into the respective suspension holes 30*a*. Thus, the hanger 30 is locked so as to be freely fitted to the adjustment cams 36 on the first door roller supporting member 23 side at the respective suspension holes 30*a*. Thus, the door 11*b* is suspended to the first door roller supporting member 23 via the hanger 30.

Note that the adjustment cams (36, 36) are rotatably attached to the first door roller supporting member 23 respectively at the door trailing end-side member 23*a* and the door leading end-side member 23*b*. The adjustment cams 36 are each provided as a disk-shaped eccentric cam. As shown in FIGS. 5, 9, and 13 for the door roller mechanism 14*a*, the adjustment cams 36 are each attached to an eccentric position with its center position being shifted with respect to the rotary shaft 36*a*. Thus, when a task of suspending the door 11*a* is performed, a worker can easily adjust the position at which the door 11*a* is suspended, by rotating each adjustment cam 36 around the rotary shaft 36*a* while shifting the center of the adjustment cam 36, and changing the angle position of the adjustment cam 36 around the rotary shaft 36*a*. Note that in FIG. 13, the position of the adjustment cam 36 that is eccentric with respect to the rotary shaft 36*a* and whose center position is disposed downward is indicated by a solid line, and the position of the adjustment cam 36' whose center position is disposed upward is indicated by a two-dot chain line.

The swing members (24, 25), the second door rollers (26, 27), the drive connection portion 28, and the elastic connection mechanism 29 will now be described, taking the door roller mechanism 14*a* as an example. A plurality of (in the present embodiment, two) swing members (24, 25) are provided that are shown in FIGS. 5, 8 to 10, and 13, and are swingably connected to the first door roller supporting member 23. A door trailing end-side swing member 24 connected to the first door roller supporting member 23 at the door trailing end-side member 23*a* on the door trailing end side and a door leading end-side swing member 25 connected to the first door roller supporting member 23 at the door leading end-side member 23*b* on the door leading end side are provided as the swing members (24, 25). The door trailing end-side swing member 24 is rotatably connected, at one end thereof, to a midway position in the lengthwise direction of the door trailing end-side member 23*a*. The door leading end-side swing member 25 is rotatably connected, at one end thereof, to a midway position in the lengthwise direction of the door leading end-side member 23*b*.

The second door rollers (26, 27) shown in FIGS. 5, 8 to 11, and 14 are provided as door rollers that are rotatably supported to the swing members (24, 25) and installed so as to be capable of coming into contact with the running surface 18 of the upper rail 13*a*. The second door rollers (26, 27) are disposed in positions that are substantially line-symmetric about the center line of the door roller mechanism 14*a*, and are provided on both the door trailing end side and the door leading end side with respect to an elastic connection mechanism 29, which will be described below. Further, the second door rollers (26, 27) are installed between the door trailing end-side first door roller 21 and the door leading end-side first door roller 22 in the opening and closing direction of the door 11*a*.

A door trailing end-side second door roller 26 disposed on the door trailing end side with respect to the center line of the door roller mechanism 14*a* and a door leading end-side second door roller 27 disposed on the door leading end side with respect to the center line of the door roller mechanism 14*a* are provided as the second door rollers (26, 27). The door trailing end-side second door roller 26 is rotatably supported via the axle 26*a* to the door trailing end-side swing member 24 at the other end of the door trailing end-side swing member 24, which is opposite to an end thereof connected to the door trailing end-side member 23*a* of the first door roller supporting member 23. The other end of the door trailing end-side swing member 24 to which the door trailing end-side second door roller 26 is supported is disposed on the door trailing end side with respect to one end thereof that is connected to the door trailing end-side member 23*a*. The door leading end-side second door roller 27 is rotatably supported via the axle 27*a* to the door leading end-side swing member 25 at the other end of the door leading end-side swing member 25, which is opposite to an end thereof connected to the door leading end-side member 23*b* of the first door roller supporting member 23. The other end of the door leading end-side swing member 25 to which the door leading end-side second door roller 27 is supported is disposed on the door leading end side with respect to the one end thereof connected to the door leading end-side member 23*b*.

Note that as clearly shown in FIGS. 5 and 9, the door trailing end-side member 23*a* of the first door roller supporting member 23 has a dent portion 37*a* having a cutout shape so as to free the space around the axle 26*a* to which the door trailing end-side second door roller 26 is rotatably supported with respect to the door trailing end-side swing member 24 and allow the door trailing end-side swing member 24 to pivot. The door leading end-side member 23*b* of the first door roller supporting member 23 has a dent portion 37*h* having a cutout shape so as to free the space around the axle 27*a* to which the door leading end-side second door roller 27 is rotatably supported with respect to the door leading end-side swing member 25 and allow the door leading end-side swing member 25 to pivot.

The structure of each first door roller (21, 22), each second door roller (26, 27), and the rail 13 will now be described in more detail. The first door roller (21, 22) and the second door roller (26, 27) shown in FIGS. 5, 8 to 11, 14, and 15 are configured as door rollers having the same shape. For this reason, the first door roller (21, 22) and the second door roller (26, 27) are formed such that the shape of first rolling surfaces 38 of the first door roller (21, 22) that roll on the running surface 19 of the lower rail 13*b* is the same as the shape of second rolling surfaces 39 of the second door roller (26, 27) that roll on the running surface 18 of the upper rail 13*a*.

Each of the first rolling surfaces 38 of the first door roller (21, 22) is provided with a pair of outer rolling surfaces (38*a*, 38*b*) and an inner rolling surface 38*c* (see FIGS. 11 and 15). The pair of outer rolling surfaces (38*a*, 38*b*) are formed as convex curved surfaces that project on the outside in a direction parallel to the rotation center line of the first door roller (21, 22). The inner rolling surface 38*c* is formed as a concave curved surface on the inside of the pair of outer rolling surfaces (38*a*, 38*b*) in the direction parallel to the aforementioned rotation center line. Each first door roller (21, 22) is installed so as to roll on the running surface 19 of the lower rail 13*b* at the inner rolling surface 38*c* of the first rolling surface 38 and thus run on the lower rail 13*b*. Note that the cross-section of the inner rolling surface 38*c* perpendicular to the door-roller circumferential direction is dented in an arc shape so as to correspond to the running surface 19.

Each of the second rolling surfaces 39 of the second door roller (26, 27) is provided with a pair of outer rolling surfaces (39*a*, 39*b*) and an inner rolling surface 39*c* (see FIGS. 11 and 14). The pair of outer rolling surfaces (39*a*, 39*b*) are formed as convex curved surfaces that project on the outside in a direction parallel to the rotation center line of the second door roller (26, 27). The inner rolling surface 39*c* is formed as a concave curved surface on the inside of the pair of outer rolling surfaces (39*a*, 39*b*) in the direction parallel to the aforementioned rotation center line.

Each second door roller (26, 27) is installed so as to roll on the running surface 18 of the upper rail 13*a* at the pair of outer rolling surfaces (39*a*, 39*b*) of the second rolling surface 39. Note that one outer rolling surface 39*a* rolls on the one concave running surface 18*a* of the running surface 18, and the other outer rolling surface 39*b* rolls on the other concave running surface 18*b* of the running surface 18. For this reason, the cross-section of the outer rolling surface 39*a* perpendicular to the door roller circumferential direction is formed so as to protrude in an arc shape so as to correspond to the concave running surface 18*a*, and the cross-section of the outer rolling surface 39*b* perpendicular to the door roller circumferential direction is formed so as to protrude in an arc so as to correspond to the concave running surface 18*b*. The projection 20 provided on the upper rail 13*a* is configured to project between the pair of outer rolling surfaces (39*a*, 39*b*) of the second door roller (26, 27).

As described above, in the present embodiment, the door suspension device 1 is configured such that the pair of outer rolling surfaces (39*a*, 39*b*) of the second door roller (26, 27) come into contact with the upper rail 13*a*, and the inner rolling surface 39*c* of the first door roller (21, 22) comes into contact with the lower rail 13*b*. However, this need not be the case. Any configuration is possible as long as the pair of outer rolling surfaces (38*a* and 38*b*, or 39*a* and 39*b*) of one of the first door roller (21, 22) and the second door roller (26, 27) come into contact with one of the upper rail 13*a* and the lower rail 13*b*, and the inner rolling surface (38*c* or 39*c*) of the other of the first door roller (21, 22) and the second door roller (26, 27) comes into contact with the other of the upper rail 13*a* and the lower rail 13*b*. Further, one of the upper rail 13*a* and the lower rail 13*b* need only be provided with the projection 20 that projects between the pair of outer rolling surfaces (38*a* and 38*b*, or 39*a* and 39*b*) of one of the first door roller (21, 22) and the second door roller (26, 27).

As shown in FIGS. 5 and 8 to 12, the drive connection portion 28 is provided as a mechanism for holding the door 11*a* and connecting the door 11*a* to the open-close drive mechanism 12. The drive connection portion 28 is fixed to the belt 17 at its upper end side, and is connected to an elastic connection mechanism 29, which will be described below, on the lower end side. Thereby, the drive connection portion 28 holds and connects the door 11*a* to the belt 17 via the elastic connection mechanism 29, the swing members (24, 25), the first door roller supporting member 23, and the hanger 30. Further, the drive connection portion 28 includes a slide member 34, a connection member 35, a drive mechanism fixing member 40, and so forth.

The slide member 34 is provided as a member installed so as to be slidably moved with respect to the first door roller supporting member 23, and is installed at a position corresponding to the middle portion of the first door roller supporting member 23. A through hole extending parallel to the lengthwise direction of the rail 13 is formed in this slide member 34, and the coupling shaft member 23*c* of the first door roller supporting member 23 is installed passing through the through hole in a state in which it is loosely fitted so as to be swingable and pivotable. Accordingly, when the first door roller supporting member 23 is relatively displaced with respect to the drive connection portion 28, the direction of the relative displacement of the first door roller supporting member 23 can be restricted so as to be guided in a direction parallel to the direction of movement of the drive connection portion 28. Thereby, the movement of the door 11*a*, which is connected to the first door roller supporting member 23 via the hanger 30, can be further restricted to a sliding movement in a plane parallel to the plane in which the upper and lower rails (13*a*, 13*b*) are disposed.

The drive mechanism fixing member 40 is provided as a member with an end 40*a* on one end side being fixed to the belt 17 of the open-close drive mechanism 12. An end 40*b* on the other end side of the drive mechanism fixing member 40 is fixed to the connection member 35. The drive mechanism fixing member 40 is shown only in the schematic diagram in FIGS. 1 and 8, and is omitted in the diagrams other than FIGS. 1 and 8.

The connection member 35 is formed separately from the slide member 34, and is provided as a block-like member connected to the open-close drive mechanism 12 via the drive mechanism fixing member 40. The connection member 35 is provided so as to be attachable to both the door leading end side and the door trailing end side of the slide member 34. Note that the present embodiment describes an exemplary state in which the connection member 35 is fixed to the slide member 34 at its end on the door trailing end side by bolts. Although the present embodiment describes an exemplary configuration in which the connection member 35 and the drive mechanism fixing member 40 are provided as separate members, this need not be the case, and the connection member 35 and the drive mechanism fixing member 40 may be configured as an integrated member.

As shown in FIGS. 5 and 8 to 12, the elastic connection mechanism 29 is provided as a mechanism for elastically connecting the swing members (24, 25) with the drive connection portion 28, and includes swingable connection members (31, 32), a spring member 33, a connecting shaft member 41, and so forth. The spring member 33 constitutes an elastic portion in the present embodiment that can change the relative positions of the second door rollers (26, 27) and the drive connection portion 28 as a result of its elastic deformation. In the present embodiment, the spring member 33 is provided as a coil spring. An end on the door trailing end side of the spring member 33 is supported to a door leading end-side swingable connection member 32, which will be described below, and an end on the door leading end side of the spring member 33 is supported to an end on the door leading end side of the connecting shaft member 41, which is a shaft-like member that passes through the inside of the spring member 33.

The door trailing end-side swing member 24 and the door leading end-side swing member 25 are rotatably connected respectively to the swingable connection members (31, 32), which are provided as link members connected to the drive connection portion 28 via the spring member 33 so as to be capable of changing their relative position. A door trailing end-side swingable connection member 31 to which the door trailing end-side swing member 24 is rotatably connected, and a door leading end-side swingable connection member 32 to which the door leading end-side swing member 25 is rotatably connected are provided as the swingable connection members (31, 32). In the elastic connection mechanism 29, the door trailing end-side swingable connection member 31 and the door leading end-side swingable connection member 32 are connected to each other via the spring member 33 so as to be capable of relatively moving in the opening and closing direction of the door 11*a*.

Now, the configuration of connection between the swing members (24, 25), the swingable connection members (31, 32), the spring member 33, the connecting shaft member 41, and the drive connection portion 28 will be described in more detail. The door trailing end-side swingable connection member 31 and the door leading end-side swingable connection member 32, which are separately provided members, are provided as thick and elongated plate-like members, and are installed so as to extend along the lengthwise direction of the rail 13. The door trailing end-side swingable connection member 31 and the door leading end-side swingable connection member 32 are installed in tandem along the lengthwise direction of the rail 13.

An end on the door trailing end side of the door trailing end-side swingable connection member 31 is rotatably connected to the door trailing end-side swing member 24. The position where the door trailing end-side swingable connection member 31 is connected to the door trailing end-side swing member 24 is set at the position between an end of the door trailing end-side swing member 24 that is connected to the first door roller supporting member 23 and an end thereof to which the door trailing end-side second door roller 26 is supported.

An end on the door leading end side of the door leading end-side swingable connection member 32 is rotatably connected to the door leading end-side swing member 25. The position where the door leading end-side swingable connection member 32 is connected to the door leading end-side swing member 25 is set at the position between an end of the door leading end-side swing member 25 that is connected to the first door roller supporting member 23 and an end thereof to which the door leading end-side second door roller 27 is supported.

An end on the door leading end side of the door trailing end-side swingable connection member 31 is provided with a bent end portion 31*a* that is bent at a substantially right angle with respect to the lengthwise direction of the door trailing end-side swingable connection member 31. An end on the door trailing end side of the door leading end-side swingable connection member 32 is provided with a bent end portion 32*a* that is bent at a substantially right angle with respect to the lengthwise direction of the door leading end-side swingable connection member 32. The bent end portion 31*a* and the bent end portion 32*a* are disposed so as to be opposed to each other. The swingable connection members (31, 32) are configured such that the distance between the bent end portion 31*a* and the bent end portion 32*a* changes with elastic deformation of the spring member 33.

The opposing bent end portion 31*a* and bent end portion 32*a* each have a through hole at opposing positions. The connecting shaft member 41 is inserted to both through holes of the bent end portions (31*a*, 32*a*) so as to pass therethrough in a loosely fitted state. A portion of the connecting shaft member 41 that projects toward the door leading end side from the through hole of the bent end portion 32*a* passes through the inside of the spring member 33, and supports an end on the door leading end side of the spring member 33 at its end on the door leading end side. That is to say, the spring member 33 is supported between the bent end portion 32*a* and an end on the door leading end side of the connecting shaft member 41 that passes through the inside of the spring member 33. Note that in the present embodiment, the spring member 33 is provided as a compression coil spring that biases the end on the door leading end side of the connecting shaft member 41 toward the door leading end side with respect to the bent end portion 32*a*, with its spring force that biases in the extending direction.

A portion of the connecting shaft member 41 that projects toward the door trailing end side from the through hole of the bent end portion 31*a* is screwed with and fixed to the connection member 35 of the drive connection portion 28 at its end on the door trailing end side. Thus, one end of the connecting shaft member 41 biased by the spring member 33 is held by the connection member 35. A plurality of nut members (42*a*, 42*b*) are screwed and thus attached between the bent end portion 31*a* of the connecting shaft member 41 and the connection member 35. The nut member 42*a* is provided as a detent member for preventing the position at which the connecting shaft member 41 is fixed to the connection member 35 from being shifted. The nut member 42*b* is installed at a position where it comes into contact with the bent end portion 31*a*, and is provided as a member for restricting the distance between the connection member 35 and the bent end portion 31*a* such that the distance is not smaller than or equal to a predetermined distance dimension. Note that a detent nut member provided at a position where is comes into contact with the nut member 42*b* is also attached to the connecting shaft member 41 in order to prevent the position of the nut member 42*b* with respect to the connecting shaft member 41 from being shifted.

The elastic connection mechanism 29 is configured to restrict displacement of the drive connection portion 28 with respect to the swingable connection members (31, 32) when the door 11*a* moves in the closing direction, due to provision of the connecting shaft member 41 and the nut member 42*b*. Further, the elastic connection mechanism 29 is configured such that the swingable connection members (31, 32) are connected to the drive connection portion 28 via the spring member 33 so as to be capable of changing the relative position of the drive connection portion 28 with respect to the swingable connection members (31, 32) as a result of elastic deformation of the spring member 33 when the door 11*a* moves in the opening direction, due to provision of the connecting shaft member 41 and the spring member 33.

Although the elastic connection mechanism 29 was described taking, as an example, the elastic portion that is the compression coil spring installed on the door leading end side with respect to the bent end portions (31*a*, 32*a*), the configuration of the elastic portion need not be the above-described one. An elastic portion configured as a spring member other than a coil spring may also be used. For example, various kinds of elastic member such as a cylindrically-formed sponge rubber may be used as the elastic portion. Further, the elastic portion may be installed on the door trailing end side with respect to the bent end portions (31*a*, 32*a*). Further, an elastic portion provided as a tension coil spring, rather than the elastic portion provided as a compression coil spring, may be used.

In the door roller mechanism 14*a*, the slide member 34 of the drive connection portion 28 is provided with a contact portion 43 capable of coming into contact with the bent end portion 32*a* of the door leading end-side swingable connection member 32. The contact portion 43 is provided as an edge portion of a portion of the slide member 34 that is formed in a cutout shape so as to define a gap in which the bent end portion 32*a* can be disposed so as to intersect. Further, the door roller mechanism 14*a* is configured such that the displacement of the drive connection portion 28 with respect to the swingable connection members (31, 32) is restricted in a predetermined distance range as a result of the contact portion 43 coming into contact with the bent end portion 32*a* of the door leading end-side swingable connection member 32.

Next, an operation of the door apparatus 2 and the door suspension device 1 described above will now be described. As described above, with the door apparatus 2, the door roller mechanisms (14*a*, 14*b*) are moved in directions in which they move away from each other by the open-close drive mechanism 12 operating in the state shown in FIG. 1, and thereby, the doors (11*a*, 11*b*) respectively suspended to the door roller mechanisms (14*a*, 14*b*) are opened as shown in FIG. 2. On the other hand, the door roller mechanisms (14*a*, 14*b*) are moved in directions in which they approach each other by the drive motor of the open-close drive mechanism 12 rotating in a direction opposite to the aforementioned opening operation in the state shown in FIG. 2, and thereby the doors (11*a*, 11*b*) are closed as shown in FIG. 1.

Further, with the door suspension device 1, the door roller mechanism 14*a* and the door roller mechanism 14*b* respectively cause the door 11*a* and the door 11*b* to slidably move in the opening and closing direction along the lengthwise direction of the rail 13 via operation of the open-close drive mechanism 12. Note that the door roller mechanism 14*a* and the door roller mechanism 14*b* operate in the same manner in states line-symmetric about the intermediate position of the two doors 11, and therefore, only the operation of the door roller mechanism 14*a* will be described below.

In the state where the door 11*a* is closed, the open-close drive mechanism 12 is not operating, and the door 11*a* is stopped with respect to the structure. In this state, the spring member 33 is biasing the swingable connection members (31, 32) at a predetermined spring force in accordance with the vertical positions of the second door rollers (26, 27) that are defined by the dimension between the upper and lower rails (13*a*, 13*b*), while the relative positions of the second door rollers (26, 27) and the drive connection portion 28 are maintained in a predetermined positional state.

When the open-close drive mechanism 12 operates in this state and the door 11*a* moves in the opening direction, an acceleration/deceleration operation (which is an operation performed before or after a constant velocity operation, and whose duration is shorter than the duration of the constant velocity operation) of the door roller mechanism 14*a* is also performed. At the time of acceleration operation of the door roller mechanism 14*a* while the door 11*a* is moving in the opening direction, the relative positional state of the swingable connection members (31, 32) and the swing members (24, 25) with respect to the door 11*a* is slightly changed by elastic deformation of the spring member 33, resulting in a change in the contact pressure exerted on the upper rail 13*a* from the second door rollers (26, 27). Similarly, in the case where a load is exerted from the door 11*a*, including, for example, cases where a foreign object has collided with or has been caught at the end in the opening direction of the door 11*a* while the door 11*a* is moving in the opening direction, the relative positional state of the swingable connection members (31, 32) and the swing members (24, 25) with respect to the door 11*a* is changed by elastic deformation of the spring member 33. Further, the position of the second door rollers (26, 27) with respect to the upper rail 13*a* is positioned at a suitable position in accordance with the aforementioned load.

Note that when the operation of the door roller mechanism 14*a* has been switched from the acceleration operation to the constant velocity operation, the state of the spring member 33 is restored to the state before acceleration operation, and the relative positional states of the swingable connection members (31, 32) and the swing members (24, 25) with respect to the door 11*a* are restored to their initial states. Further, the contact pressure exerted on the upper rail 13*a* from the second door rollers (26, 27) is restored to its initial state, and the running resistance is thereby reduced.

On the other hand, the acceleration/deceleration operation of the door roller mechanism 14*a* is also performed in the case where the open-close drive mechanism 12 operates in the state where the door 11*a* is opened and stopped and the door 11*a* moves in the closing direction. At the time of the acceleration operation of the door roller mechanism 14*a* while the door 11*a* is moving in the closing direction, displacement of the drive connection portion 28 with respect to the swingable connection members (31, 32) is restricted by the connecting shaft member 41 and the nut member 42*b*, and the spring member 33 does not undergo elastic deformation. Similarly, in the case where a load is exerted from the door 11*a*, including, for example, cases where a foreign object has collided with or has been caught at the end in the closing direction of the door 11*a* while the door 11*a* is moving in the closing direction, displacement of the drive connection portion 28 with respect to the swingable connection members (31, 32) is restricted, and the spring member 33 does not undergo elastic deformation. Accordingly, a mechanism for preventing the derailing of the door roller mechanism 14*a* immediately operates when the door 11*a* moves in the closing direction.

With the door suspension device 1 and the door apparatus 2 described thus far, the first door rollers (21, 22) supported to the first door roller supporting member 23 that suspends the doors 11 (11*a*, 11*b*) run on the lower rail 13*b*, and the second door rollers supported to the swing members (24, 25) that are swingably connected to the first door roller supporting member 23 are installed so as to be capable of coming into contact with the upper rail 13*a*. Accordingly, the first door rollers (21, 22) and the second door rollers (26, 27) that are installed between the upper and lower rails (13*a*, 13*b*) and run thereon constitute a derailing prevention mechanism, and therefore, it is possible to reliably prevent the derailing of the door rollers (21, 22, 26, 27) and the tilting of the doors 11 (11*a*, 11*b*) when the doors 11 (11*a*, 11*b*) are opened and closed.

Furthermore, with the door suspension device 1 and the door apparatus 2, the elastic connection mechanism 29 that connects the drive connection portion 28 for connecting the doors 11 (11*a*, 11*b*) to the open-close drive mechanism 12 to the swing members (24, 25) includes the spring member 33 serving as an elastic portion, and the elastic connection mechanism 29 is provided so as to be capable of changing the relative positions of the second door rollers (26, 27) and the drive connection portion 28 by elastic deformation. Accordingly, at the time of acceleration or deceleration when the doors 11 (11*a*, 11*b*) are driven to be opened and closed, the elastic connection mechanism 29 and the swing members (24, 25) are relatively displaced with respect to the doors 11 (11*a*, 11*b*) by the elastic deformation of the spring member 33, and the contact pressure exerted on the upper rail 13*a* from the second door rollers (26, 27) is temporarily increased. However, the elastic deformation of the spring member 33 is immediately restored when the velocity is constant, and consequently, the distance relationship between the upper rail 13*a* and the second door rollers (26, 27) is brought back to the original state. Further, even if a load is exerted from the doors 11 (11*a*, 11*b*) in a direction in which the elastic deformation of the spring member 33 is caused as the result of a foreign object having collided with or having been caught at the end of the doors 11 (11*a*, 11*b*) in the opening and closing direction, the elastic connection mechanism 29 and the swing members (24, 25) are relatively displaced with respect to the doors 11 (11*a*, 11*b*) by elastic deformation of the spring member 33, and the positions of the second door rollers (26, 27) with respect to the upper rail 13*a* are positioned in suitable positions according to the above-described load.

Accordingly, with the door suspension device 1 and the door apparatus 2, the second door rollers (26, 27) are disposed in light contact with the upper rail 13*a*, and thereby, it is possible to set a state in which running resistance can be sufficiently reduced in a derailing prevention mechanism when the door rollers (21, 22, 26, 27) are running on the rail 13. At the time of acceleration/deceleration of the doors 11 (11*a*, 11*b*) or the collision with a foreign object, the door rollers (21, 22, 26, 27) can also be positioned in suitable positions according to the load, and the derailing of the door rollers (21, 22, 26, 27) and the tilting of the doors 11 (11*a*, 11*b*) can be reliably prevented. Further, according to the present embodiment, the positional adjustment of the second door rollers (26, 27), namely, the degree to which the second door rollers (26, 27) are in contact with the upper rail 13*a* has little impact on the above-described derailing prevention performance. Accordingly, the positional adjustment requires little time and effort at the time of installing the door suspension device 1, and the installation operation can be performed easily.

Further, with the door suspension device 1 and the door apparatus 2, the second door rollers (26, 27) are installed between the door leading end-side first door roller 21 and the door trailing end-side first door roller 22. Accordingly, the second door rollers (26, 27), the swing members (24, 25), and the elastic connection mechanism 29 can be provided inward of the door leading end-side and door trailing end-side first door rollers (21, 22). Thus, a problem will not arise in that the size of the structure is increased as a result of the necessity for installing the second door rollers, the swing members, and the elastic connection mechanism while avoiding the first door rollers due to restriction on the apparatus layout. That is to say, the second door rollers (26, 27), the swing members (24, 25), and the elastic connection mechanism 29 can be compactly installed inward of the door leading end-side and door trailing end-side first door rollers (21, 22), and thus, a compact structure of the door suspension device 1 and the door apparatus 2 can be achieved.

Therefore, according to this embodiment, it is possible to provide a door suspension device 1 and a door apparatus 2 that can reliably prevent the derailing of door rollers (21, 22, 26, 27) and the tilting of doors 11 (11*a*, 11*b*) when the doors 11 (11*a*, 11*b*) are opened and closed, while reducing running resistance caused by a derailing prevention mechanism.

With the door suspension device 1 and the door apparatus 2, the second door rollers (26, 27) are provided on both the door leading end side and the door trailing end side with respect to the elastic connection mechanism 29. Accordingly, both during the opening driving and the closing driving of the doors 11 (11*a*, 11*b*), the positions of the second door rollers (26, 27) with respect to the upper rail 13*a* can be stably positioned in suitable positions at the time of the acceleration/deceleration or when a foreign object has collided with the end of the doors. Accordingly, it is possible to achieve a door suspension device 1 and a door apparatus 2 having a compact structure that can reliably prevent the derailing of the door rollers (21, 22, 26, 27) and the tilting of the doors 11 (11*a*, 11*b*) when the doors 11 (11*a*, 11*b*) are opened and closed, while reducing running resistance caused by a derailing prevention mechanism, both during the opening driving and the closing driving of the doors 11 (11*a*, 11*b*).

Further, with the door suspension device 1 and the door apparatus 2, the displacement of the drive connection portion 28 with respect to the swingable connection members (31, 32) to which the door trailing end-side swing member 24 and the door leading end-side swing member 25 are rotatably connected is allowed by elastic deformation of the spring member 33 when the doors 11 (11*a*, 11*b*) move in the opening direction, and is restricted when the doors 11 (11*a*, 11*b*) move in the closing direction. For this reason, an improvement in the responsiveness of the derailing prevention mechanism is achieved at the time of moving of the doors 11 (11*a*, 11*b*) in the closing direction during which the derailing of the door rollers (21, 22, 26, 27) and the tilting of the doors 11 (11*a*, 11*b*) are more likely caused than at the time of moving of the doors 11 (11*a*, 11*b*) in the opening direction. Accordingly, the derailing of the door rollers (21, 22, 26, 27) and the tilting of the doors 11 (11*a*, 11*b*) can be further reliably prevented.

With the door suspension device 1 and the door apparatus 2, the door trailing end-side swingable connection member 31 connected to the door trailing end-side swing member 24 to which the door trailing end-side second door roller 26 is supported and the door leading end-side swingable connection members 32 connected to the door leading end-side swing member 25 to which the door leading end-side second door roller 27 is supported are connected to each other so as to be capable of relatively moving in the door opening and closing direction via the spring member 33. For this reason, the distance between the door trailing end-side second door roller 26 and the door leading end-side second door roller 27 and the angle in the direction in which the door trailing end-side swing member 24 and the door leading end-side swing member 25 swing with respect to the first door roller supporting member 23 are automatically adjusted by the operation of the spring member 33, in accordance with the distance dimension between the upper rail 13*a* and the lower rail 13*b*. Accordingly, the second door rollers (26, 27) come into contact with the upper rail 13*a* automatically at a predetermined contact pressure or less, regardless of the distance dimension between the upper and lower rails (13*a*, 13*b*), and therefore, the positional adjustment requires no time and effort when the door suspension device 1 is installed, and the installation task can be performed very easily.

With the door suspension device 1 and the door apparatus 2, the contact portion 43 of the drive connection portion 28 comes into contact with the door leading end-side swingable connection member 32, and the displacement of the drive connection portion 28 with respect to the swingable connection members (31, 32) are thereby restricted in a predetermined distance range. For this reason, the derailing prevention mechanism can be reliably operated at the stage where the displacement of the drive connection portion 28 with respect to the swingable connection members (31, 32) reaches the predetermined distance, regardless of the amount of the elastic deformation of the spring member 33.

With the door suspension device 1 and the door apparatus 2, the connection member 35 of the drive connection portion 28 that holds one end of the connecting shaft member 41 connected to the open-close drive mechanism 12 and biased by the spring member 33 is provided so as to be attachable to both the door leading end side and the door trailing end side of the slide member 34. For this reason, the same parts including the slide member 34, the connection member 35, and the spring member 33 can be used for both right-handed doors and left-handed doors. Thus, the parts can be easily managed.

With the door suspension device 1 and the door apparatus 2, the first door roller supporting member 23 has the dent portions (37*a*, 37*b*) having a cutout shape that frees the space around the axles (26*a*, 27*a*) of the second door rollers (26, 27) so as to allow the swing members (24, 25) to pivot. For this reason, a structure can be realized in which the second door rollers (26, 27) and the swing members (24, 25) are closely installed, and the first door rollers (21, 22) and the first door roller supporting member 23 are closely installed. Thus, the door suspension device 1 and the door apparatus 2 can be made more compact.

With the door suspension device 1 and the door apparatus 2, at least the first rolling surface 38 and the second rolling surface 39 have the same shape in the first door rollers (21, 22) and the second door rollers (26, 27), and therefore, the parts of the first door rollers (21, 22) and the second door rollers (26, 27) can be easily managed. Further, the pair of outer rolling surfaces (39*a*, 39*b*), which are convex curved surfaces, of the second door rollers (26, 27) come into contact with the upper rail 13*a*, the inner rolling surface 38*c*, which is a concave curved surface, of the first door rollers (21, 22) comes into contact with the lower rail 13*b*, and further, the upper rail 13*a* is provided with the projection 20 that projects between the pair of outer rolling surfaces (39*a*, 39*b*) that comes into contact with the upper rail 13*a*. For this reason, even if the first and second door rollers (21, 22, 26, 27) tilt between the upper and lower rails (13*a*, 13*b*) in a direction perpendicular to the rail lengthwise direction, the first and second door rollers (21, 22, 26, 27) are further reliably prevented from derailing from the rail 13.

With the door suspension device 1 and the door apparatus 2, the pair of outer rolling surfaces (39*a*, 39*b*) of the second door rollers (26, 27) come into contact with the upper rail 13*a*, the inner rolling surface 38*c* of the first door rollers (21, 22) comes into contact with the lower rail 13*b*, and the projection 20 of the upper rail 13*a* projects between the pair of outer rolling surfaces (39*a*, 39*b*) of the second door rollers (26, 27). For this reason, even in the case where the doors 11 (11*a*, 11*b*) are in an overhanging state in which they are suspended while tilting toward the side of the rail 13, a state in which the running resistance of the second door rollers (26, 27) is sufficiently reduced is maintained in a range in which the second door rollers (26, 27) tilt while the pair of outer rolling surfaces (39*a*, 39*b*) do not come into contact with the projection 20 of the upper rail 13*a*. That is to say, even in the case where the doors 11 (11*a*, 11*b*) are in the overhanging state, the tilting of the door rollers (21, 22, 26, 27) is efficiently absorbed, and a state in which the running resistance of the second door rollers (26, 27) is sufficiently reduced is maintained.

Although the embodiments of the present invention were described thus far, the present invention is not limited to the above-described embodiments, and may be modified in various manners for implementation within the scope recited in Claims. For example, a single door 11 may be provided, and the following variations may also be made.

(1) Although the above embodiment was described taking, as an example, a configuration in which two first door rollers and two second door rollers are provided in the door roller mechanism, this need not be the case, and the number of the first door rollers and the second door rollers provided in the door roller mechanism may be changed for implementation.

(2) Although the above embodiment was described, taking, as an example, a configuration in which the second door roller is rotatably connected to each of the swing members, this need not be the case. That is to say, it is sufficient to provide a second door roller that is rotatably supported to at least one of a plurality of swing members.

(3) Although the above embodiment was described taking, as an example, a configuration in which the door leading end-side swingable connection member and the door trailing end-side swingable connection member are provided as the swingable connection members, this need not be the case. A configuration is also possible in which the swingable connection members are configured as an integrated member.

(4) Although the above embodiment was described taking, as an example, a configuration in which the contact portion of the drive connection portion is provided so as to be capable of coming into contact with the door leading end-side swingable connection member, this need not be the case. The contact portion of the drive connection portion may be provided so as to be capable of coming into contact with the door trailing end-side swingable connection member, or may be provided so as to be capable of coming into contact with both the door leading end-side swingable connection member and the door trailing end-side swingable connection member.

(5) Although the above embodiment was described taking, as an example, a configuration in which the connection member of the drive connection portion holds one end of the shaft-like member biased by the elastic portion, this need not be the case. A configuration in which the connection member of the drive connection portion holds one end of the elastic portion may also be implemented.

INDUSTRIAL APPLICABILITY

The present invention is widely applicable as a door suspension device that supports a door provided in a structure and driven to be opened and closed by an open-close drive mechanism, in a state in which the door is suspended to the structure so as to be slidably moved, and that is connected to the open-close drive mechanism, and a door apparatus provided with the door suspension device.

DESCRIPTIONS OF REFERENCE NUMERALS

1 door suspension device
11, 11*a*, 11*b* door
12 open-close drive mechanism
13 rail
13*a* upper rail
13*b* lower rail
18, 19 running surface
21 door trailing end-side first door roller (first door roller)
22 door leading end-side first door roller (first door roller)
23 first door roller supporting member
24 door trailing end-side swing member (swing member)
25 door leading end-side swing member (swing member)
26 door trailing end-side second door roller (second door roller)
27 door leading end-side second door roller (second door roller)
28 drive connection portion
29 elastic connection mechanism
33 spring member (elastic portion)

The invention claimed is:

1. A door suspension device that supports a door provided in a structure and driven to be opened and closed by an open-close drive mechanism, in a state in which the door is suspended to the structure so as to be slidably moved, and that is connected to the open-close drive mechanism, the device comprising:

a rail that is fixed to the structure and includes an upper rail and a lower rail that are provided with respective running surfaces opposing each other in a vertical direction;

at least one first door roller that runs in contact with the running surface of the lower rail;

a first door roller supporting member that suspends the door and rotatably supports the first door roller;

a door leading end-side swing member that is connected to the first door roller supporting member;

a door trailing end-side swing member that is connected to the first door roller supporting member;

at least two second door rollers that are rotatably supported to the door leading end-side swing member and the door trailing end-side swing member and are provided so as to be capable of coming into contact with the running surface of the upper rail;

a drive connection portion for holding the first door roller supporting member and connecting the first door roller supporting member to the open-close drive mechanism; and an elastic connection mechanism that includes one elastic portion, wherein one of the at least two second door rollers is closer to a leading end of the door moving in a closing direction than the elastic connection mechanism and whereas another of the at least two second door rollers is closer to a trailing end of the door moving in the closing direction than the elastic connection mechanism, wherein the door leading end-side swing member is closer to the leading end than the door trailing end-side swing member, wherein the elastic connection mechanism includes swingable connection members to which the door leading end-side swing member and the door trailing end-side swing member are rotatably connected, respectively, and wherein the swingable connection members are connected to the drive connection portion via the elastic portion so as to restrict displacement of the drive connection portion with respect to the swingable connection members when the door moves in the closing direction, and so as to be capable of changing a relative position of the drive connection portion with respect to the swingable connection members by elastic deformation of the elastic portion when the door moves in an opening direction opposite to the closing direction.

2. The door suspension device according to claim 1, wherein a door leading end-side swingable connection member to which the door leading end-side swing member is rotatably connected and a door trailing end-side swingable connection member to which the door trailing end-side swing member is rotatably connected are provided as the swingable connection members, a door leading end-side second door roller that is rotatably supported with respect to the door leading end-side swing member and a door trailing end-side second door roller that is rotatably supported with respect to the door trailing end-side swing member are provided as the at least two second door rollers, and the door leading end-side swingable connection member and the door trailing end-side swingable connection member are connected to each other via the elastic portion so as to be capable of relatively moving in the opening and closing direction of the door.

3. The door suspension device according to claim 2, wherein the drive connection portion is provided with a contact portion capable of coming into contact with the door leading end-side swingable connection member, and displacement of the drive connection portion with respect to the swingable connection members is restricted in a predetermined distance range as a result of the contact portion coming into contact with at least one of the door leading end-side swingable connection member and the door trailing end-side swingable connection member.

4. The door suspension device according to claim 1, wherein the drive connection portion includes a slide member installed so as to be slidably moved with respect to the first door roller supporting member, and a connection member that is formed separately from the slide member and connected to the open-close drive mechanism, and wherein the connection member is attached to the slide member near the trailing end, and holds one end of the elastic portion or one end of a shaft biased by the elastic portion.

5. The door suspension device according to claim 1, wherein the first door roller supporting member has a dent portion having a cutout shape so as to free a space around an axle to which one of the at least two second door rollers is rotatably supported with respect to the door leading end-side swing member and the door trailing end-side swing member, and allowing the door leading end-side swing member and the door trailing end-side swing member to pivot.

6. The door suspension device according to claim 1, wherein in the at least one first door roller and one of the at least two second door rollers, rolling surfaces that roll on the lower rail and the upper rail have a same shape, the rolling surfaces are each provided with a pair of outer rolling surfaces formed as convex curved surfaces spaced from each other in a direction parallel to rotational axes of the at least one first door roller and the one of the at least two second door rollers, and an inner rolling surface formed as a concave curved face between the pair of outer rolling surfaces in the parallel direction, the outer rolling surfaces of one of the at least one first door roller and the one of the at least two second door rollers come into contact with one of the upper rail and the lower rail, and the inner rolling surface of the other of the at least one first door roller and the one of the at least two second door rollers comes into contact with the other of the upper rail and the lower rail, and one of the upper rail and the lower rail is provided with a projection that projects between the pair of outer rolling surfaces of the one of the at least one first door roller and the one of the at least two second door rollers.

7. The door suspension device according to claim 1, wherein in the at least one first door roller and one of the at least two second door rollers, rolling surfaces that roll on the lower rail and the upper rail have a same shape, the rolling surfaces are each provided with a pair of outer rolling surfaces formed as convex curved surfaces that project on an outside in a direction parallel to rotational axes of the at least one first door roller and the one of the at least two second door rollers, and an inner rolling surface formed as a concave curved face on an inside of the pair of outer rolling surfaces in the parallel direction, and the pair of outer rolling surfaces of the one of the at least two second door rollers come into contact with the upper rail, and the inner rolling surface of the at least one first door roller comes into contact with the lower rail.

8. A door apparatus comprising:

the door suspension device according to claim 1, the door that is provided in the structure and is supported by the door suspension device in a state of being suspended to the structure so as to be slidably moved; and the open-close drive mechanism that is connected to the drive connection portion of the door suspension device to drive the door to be opened and closed.

9. The door suspension device according to claim 1, wherein the at least one first door roller comprises two first door rollers provided near each of the leading end and the trailing end of the door, and one of the at least two second door rollers is installed between one of the two first door rollers near the leading end and one of the two first door rollers near the trailing end.

* * * * *